US009864286B2

(12) United States Patent
Mera et al.

(10) Patent No.: US 9,864,286 B2
(45) Date of Patent: Jan. 9, 2018

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Fumiaki Mera, Kanagawa (JP); Nobuyuki Torigoe, Kanagawa (JP); Masaki Hirakata, Kanagawa (JP); Hideya Katsuhara, Kanagawa (JP); Yoichi Kigoshi, Kanagawa (JP); Satomi Kashiwagi, Kanagawa (JP); Yuko Iwadate, Kanagawa (JP); Kenji Kajiwara, Kanagawa (JP); Tatsuki Sano, Kanagawa (JP); Takashi Imai, Kanagawa (JP); Takeshi Iwanaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/206,020

(22) Filed: Jul. 8, 2016

(65) Prior Publication Data

US 2017/0269486 A1 Sep. 21, 2017

(30) Foreign Application Priority Data

Mar. 16, 2016 (JP) ..... 2016-052882

(51) Int. Cl.

| | |
|---|---|
| ***G03G 5/14*** | (2006.01) |
| ***G03G 5/147*** | (2006.01) |
| ***G03G 5/043*** | (2006.01) |
| ***G03G 21/18*** | (2006.01) |
| ***G03G 5/05*** | (2006.01) |

(52) U.S. Cl.
CPC ..... *G03G 5/14704* (2013.01); *G03G 5/0436* (2013.01); *G03G 5/0507* (2013.01); *G03G 21/18* (2013.01)

(58) Field of Classification Search
CPC . G03G 5/14704; G03G 5/0507; G03G 5/0436
USPC ..... 430/58.1, 58.05, 66, 67
See application file for complete search history.

(56) References Cited

U.S. PATENT DOCUMENTS

| | | | | |
|---|---|---|---|---|
| 2008/0254379 | A1 | 10/2008 | Iwanaga et al. | |
| 2010/0203435 | A1* | 8/2010 | Iwanaga ..... | G03G 5/14704 430/56 |
| 2010/0330481 | A1 | 12/2010 | Yagi | |
| 2013/0344422 | A1 | 12/2013 | Iwanaga et al. | |
| 2014/0295334 | A1 | 10/2014 | Hirakata et al. | |

FOREIGN PATENT DOCUMENTS

| | | | |
|---|---|---|---|
| JP | 2008-268266 | A | 11/2008 |
| JP | 2011-028218 | A | 2/2011 |
| JP | 2014-006351 | A | 1/2014 |
| JP | 2014-191179 | A | 10/2014 |

* cited by examiner

*Primary Examiner* — Janis L Dote
(74) *Attorney, Agent, or Firm* — Oliff PLC

(57) ABSTRACT

An electrophotographic photoreceptor includes an electroconductive substrate, an organic photosensitive layer on the electroconductive substrate and an inorganic protective layer on the organic photosensitive layer, wherein a layer that forms a surface of the organic photosensitive layer contains a charge transporting material, a binder resin, and a silica particle; the inorganic protective layer contains a group 13 element, an oxygen atom, and a hydrogen atom; a sum of element constitution ratios of the group 13 element, the oxygen atom, and the hydrogen atom to all elements constituting the inorganic protective layer is equal to or more than 90 atomic %; and an element composition ratio (oxygen atom/group 13 element) of the oxygen atom and the group 13 element is 1.0 or more and less than 1.5.

3 Claims, 8 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-052882 filed Mar. 16, 2016.

BACKGROUND

1. Technical Field

The present invention relates to an electrophotographic photoreceptor, a process cartridge, and an image forming apparatus.

SUMMARY

According to an aspect of the invention, there is provided an electrophotographic photoreceptor including:

an electroconductive substrate;

an organic photosensitive layer on the electroconductive substrate; and an inorganic protective layer on the organic photosensitive layer, wherein a layer that constitutes a surface of the organic photosensitive layer contains a charge transporting material, a binder resin, and a silica particle, the inorganic protective layer contains a group 13 element, an oxygen atom, and a hydrogen atom, a sum of element constitution ratios of the group 13 element, the oxygen atom, and the hydrogen atom to all elements constituting the inorganic protective layer is equal to or more than 90 atomic %, and an element composition ratio (oxygen atom/group 13 element) of the oxygen atom and the group 13 element is 1.0 or more and less than 1.5.

BRIEF DESCRIPTION OF THE DRAWINGS

Exemplary embodiments of the present invention will be described in detail based on the following figures, wherein.

DETAILED DESCRIPTION

Figure 1:
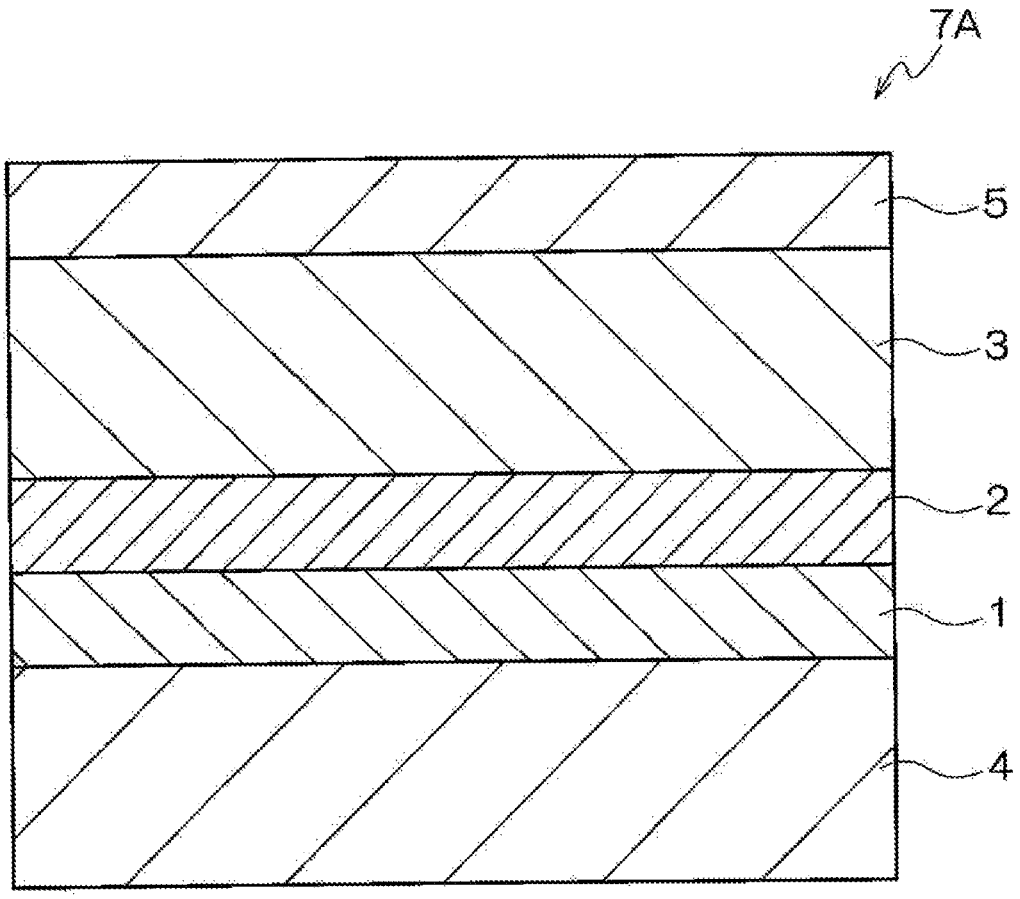
FIG. 1 is a schematic sectional view illustrating an example of a layer configuration of an electrophotographic photoreceptor according to an exemplary embodiment.

Hereinafter, exemplary embodiments of the invention will be described in detail.

Electrophotographic Photoreceptor

According to a first exemplary embodiment, there is provided an electrophotographic photoreceptor which includes an electroconductive substrate, an organic photosensitive layer provided on the electroconductive substrate, an inorganic protective layer provided on the organic photosensitive layer.

A layer which constitutes a surface of the organic photosensitive layer in the organic photosensitive layer contains a charge transporting material, a binder resin, and silica particles.

The inorganic protective layer contains a group 13 element, an oxygen atom, and a hydrogen atom. In the inorganic protective layer, sum of element constitution ratios of the group 13 element, the oxygen atom, and the hydrogen atom to all elements constituting the inorganic protective layer is equal to or more than 90 atomic %. An element composition ratio (oxygen atom/group 13 element) of the oxygen atom and the group 13 element is 1.0 or more, and less than 1.5.

According to a second exemplary embodiment, there is provided an electrophotographic photoreceptor which includes an electroconductive substrate, an organic photosensitive layer provided on the electroconductive substrate, and an inorganic protective layer provided on the organic photosensitive layer.

A layer which constitutes a surface of the organic photosensitive layer in the organic photosensitive layer contains a charge transporting material, a binder resin, and silica particles.

The inorganic protective layer contains a group 13 element, an oxygen atom, and a hydrogen atom. In the inorganic protective layer, sum of element constitution ratios of the group 13 element, the oxygen atom, and the hydrogen atom to all elements constituting the inorganic protective layer is equal to or more than 90 atomic %. Volume resistivity is $5.0\times10^{7}$ Ωcm or more, and less than $1.0\times10^{12}$ Ωcm.

Specifically, in the electrophotographic photoreceptor according to the first exemplary embodiment and the second exemplary embodiment (in this specification, regarding descriptions for items common between the first exemplary embodiment and the second exemplary embodiment, the first exemplary embodiment and the second exemplary embodiment are referred to as "this exemplary embodiment"), in a case where the organic photosensitive layer is a single-layer type organic photosensitive layer, the organic photosensitive layer contains a charge generation material, a charge transporting material, a binder resin, and silica particles.

In a case where the organic photosensitive layer is a function separation type organic photosensitive layer, the organic photosensitive layer is preferably an organic photosensitive layer in which a charge generation layer and a charge transport layer are provided on an electroconductive substrate in this order. The charge transport layer contains a charge transporting material, a binder resin, and silica particles. In a case where the charge transport layer is configured by two layers or more, a layer (top layer of the charge transport layer) of the charge transport layer, which forms the surface of the charge transport layer contains the charge transporting material, the binder resin, and the silica particles.

Here, the conventional technology of forming an inorganic protective layer on an organic photosensitive layer is known.

However, the organic photosensitive layer has flexibility, and tends to be easily deformed. The inorganic protective layer is hard and tends to have poor toughness. Thus, if the organic photosensitive layer which functions as a base layer of the inorganic protective layer is deformed, cracks may be formed in the inorganic protective layer. It is considered that since a mechanical load is easily applied to the electrophotographic photoreceptor from a member (for example, intermediate transfer member) which is disposed so as to come into contact with the surface of the electrophotographic photoreceptor, such a situation easily occurs.

The layer which constitutes the surface of the organic photosensitive layer contains the charge transporting material, the binder resin, and the silica particles, and thus the silica particles function as a reinforcement material of the organic photosensitive layer. Accordingly, it is considered that deformation of the organic photosensitive layer is difficult, and it is considered that the occurrence of cracks in the inorganic protective layer is prevented.

However, for example, in a case where carriers are scattered from a developing unit in a developing process, and the scattered carriers adhere to the electrophotographic photoreceptor, the carriers which are in a state of adhering to the electrophotographic photoreceptor reach a transfer position. A pressing force is applied at the transfer position, in a state where the carriers are interposed between the electrophotographic photoreceptor and a transfer unit. For the reason, cracks such as a dent may be caused in the inorganic protective layer even when the organic photosensitive layer contains the silica particles. The carriers are rubbed between the electrophotographic photoreceptor and the transfer unit, and therefore, cracks such as a stripe-shaped scar may occur.

The image forming apparatus needs a high speed and a reduced size. For example, an image forming apparatus having a reduced size without a decrease of an image forming speed (process speed) (also below referred to as "image forming apparatus which has a high speed and a reduced size") is required. In order to form an image forming apparatus which has a high speed and a reduced size, for example, the diameter of an electrophotographic photoreceptor included in the image forming apparatus may be designed so as to be smaller than the diameter of the conventional electrophotographic photoreceptor. For example, the number of rotations of an electrophotographic photoreceptor in the conventional image forming apparatus is less than 8 times per second of the above electrophotographic photoreceptor. Since the electrophotographic photoreceptor in the image forming apparatus which has a high speed and a reduced size is designed so as to have a small diameter, the number of rotations of the electrophotographic photoreceptor is, for example, more than 8 times persecond, and this is more than that of the conventional electrophotographic photoreceptor.

Here, in a case where an electrophotographic photoreceptor in which an inorganic protective layer is formed on an organic photosensitive layer containing silica particles (also below referred to as "electrophotographic photoreceptor including an inorganic protective layer") is applied to the conventional image forming apparatus, even when cracks are formed in the inorganic protective layer, an occurrence of image blur is not recognized.

However, in a case where an electrophotographic photoreceptor including an inorganic protective layer is applied to the image forming apparatus which has a high speed and a reduced size, it is recognized that image blur occurs in an area corresponding to cracks occurring in inorganic protective layer. It is considered that the phenomenon occurs, for example, due to accumulation of charges in the cracks formed in the inorganic protective layer (particularly, cracks occurring in the surface) of.

In a case where the number of rotations of the electrophotographic photoreceptor per second is small, it is considered that a cycle of charging and a cycle of erasing are balanced in repetition of a series of processes (image forming cycle) for forming an image. Thus, even when cracks occur in the inorganic protective layer, accumulation of charges in an area in which cracks occur is prevented.

In a case where the number of rotations of the electrophotographic photoreceptor per second is large, balancing between the cycle of charging and the cycle of erasing is difficult by repetition of the image forming cycle. Thus, charges are easily accumulated at a portion where the cracks occur in the inorganic protective layer. It is considered that accumulation of charges causes disturbance to occur in forming a latent image, and thus image blur occurs in the area corresponding to the cracks occurring in the inorganic protective layer.

In addition, as the silica particles, silica particles which cause formation of a charge accumulation site to be difficult are used among inorganic particles. However, the organic photosensitive layer which contains the silica particles easily has volume resistivity higher than an organic photosensitive layer which does not contain the silica particles. Thus, if the number of rotations of the electrophotographic photoreceptor per second is large (for example, more than 8 times/second), repetition of the image forming cycle causes a residual potential to easily occur in the organic photosensitive layer. Thus, the residual potential occurs, and thus image blur may easily occur.

On the contrary, in the electrophotographic photoreceptor according to the first exemplary embodiment, the inorganic protective layer contains the group 13 element, an oxygen atom, and a hydrogen atom. The sum of element constitution ratios of the group 13 element, the oxygen atom, and the hydrogen atom to all elements constituting the inorganic protective layer is equal to or more than 90 atomic %. An element composition ratio (oxygen atom/group 13 element) of the oxygen atom and the group 13 element is 1.0 or more and less than 1.5.

In the electrophotographic photoreceptor according to the second exemplary embodiment, volume resistivity of the inorganic protective layer is $5.0\times10^{7}$ Ωcm or more and less than $1.0\times10^{12}$ Ωcm.

In the electrophotographic photoreceptor according to the first exemplary embodiment, regarding materials which form the inorganic protective layer, if the element composition ratio (oxygen atom/group 13 element) is in a range of being less than 1.5, oxygen defect occurs. Thus, electrons easily move in the surface of the inorganic protective layer. Accordingly, in the inorganic protective layer, accumulation of charges is prevented, and thus accumulation of charges is prevented even in cracks occurring in the inorganic protective layer. As a result, even when the electrophotographic photoreceptor according to the first exemplary embodiment is applied to an image forming apparatus in which an electrophotographic photoreceptor is rotated, for example, at the number of rotations of not less than 8.0 times per second, and cracks occur in an inorganic protective layer of the electrophotographic photoreceptor, the occurrence of the image blur is prevented.

If excessive electrons move, the occurrence of the image blur is prevented, but fixing of charges is difficult. This easily causes an occurrence of image deletion. However, the element composition ratio (oxygen atom/group 13 element) is in a range of being more than 1.0, and thus excessive moving of electrons is prevented. Accordingly, the occurrence of the image deletion is also prevented.

In the electrophotographic photoreceptor according to the second exemplary embodiment, the volume resistivity of the inorganic protective layer is less than $1.0\times10^{12}$ Ωcm. Since the volume resistivity of the inorganic protective layer satisfies the range, and thus in-plane resistance of the inorganic protective layer is reduced, accumulation of charges at the portion of cracks occurring in the inorganic protective layer is prevented. Thus, even when the electrophotographic photoreceptor according to the second exemplary embodiment is applied to the image forming apparatus in which the electrophotographic photoreceptor is rotated, for example, at the number of rotations of being more than 8.0 times per second, and cracks occur in the inorganic protective layer of the electrophotographic photoreceptor, the occurrence of the image blur is prevented.

If the volume resistivity of the inorganic protective layer is excessively small, fixing of charges is difficult. This easily causes the occurrence of the image deletion. However, the volume resistivity of the inorganic protective layer is in a range of being more than $5.0\times10^{7}$ Ωcm, and thus excessive reduction of the resistance is prevented, and the occurrence of the image deletion is also prevented.

From the above descriptions, it is estimated that the configuration of the electrophotographic photoreceptors according to the first exemplary embodiment and the second exemplary embodiment causes the occurrence of the image deletion to be prevented, and causes the occurrence of the image blur to be prevented.

The electrophotographic photoreceptor according to this exemplary embodiment will be described below in detail with reference to the drawings. In the drawings, the same parts or the corresponding parts are denoted by the same reference signs and repetitive descriptions will be omitted.

Figure 2:
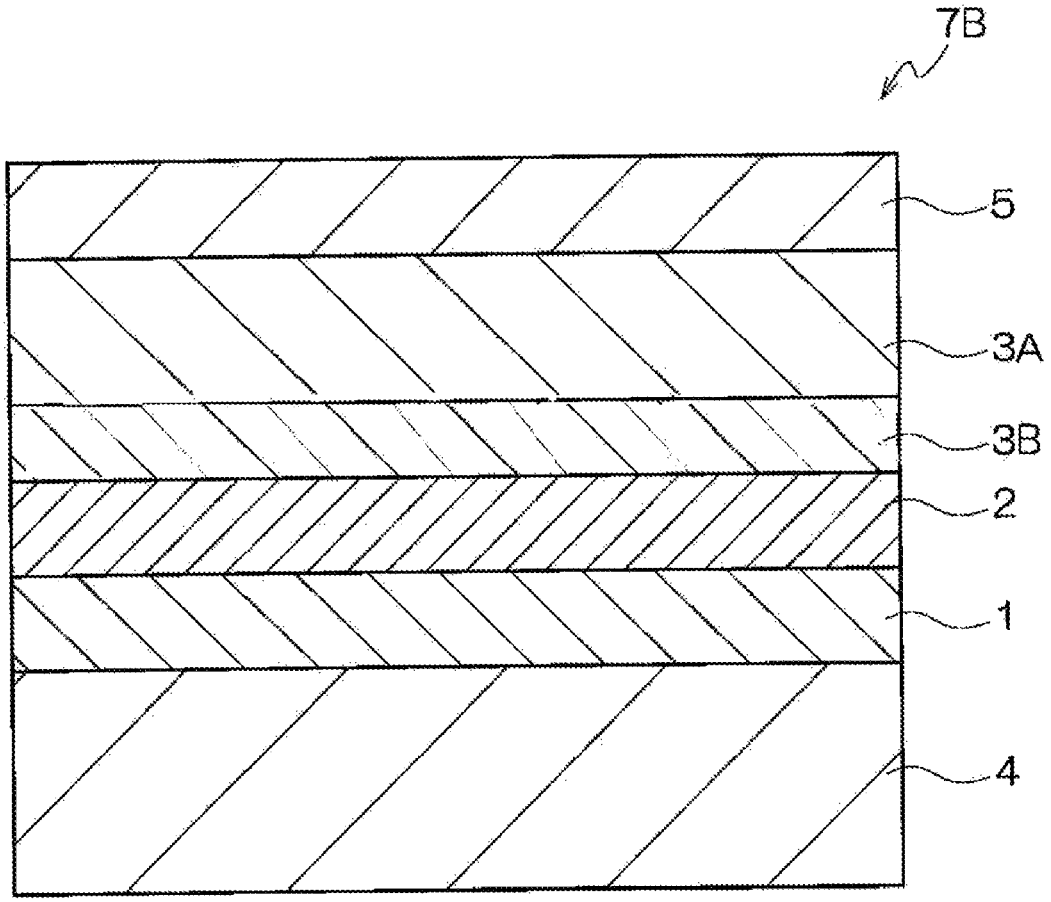
FIG. 2 is a schematic sectional view illustrating another example of the layer configuration of the electrophotographic photoreceptor according to the exemplary embodiment.
Figure 3:
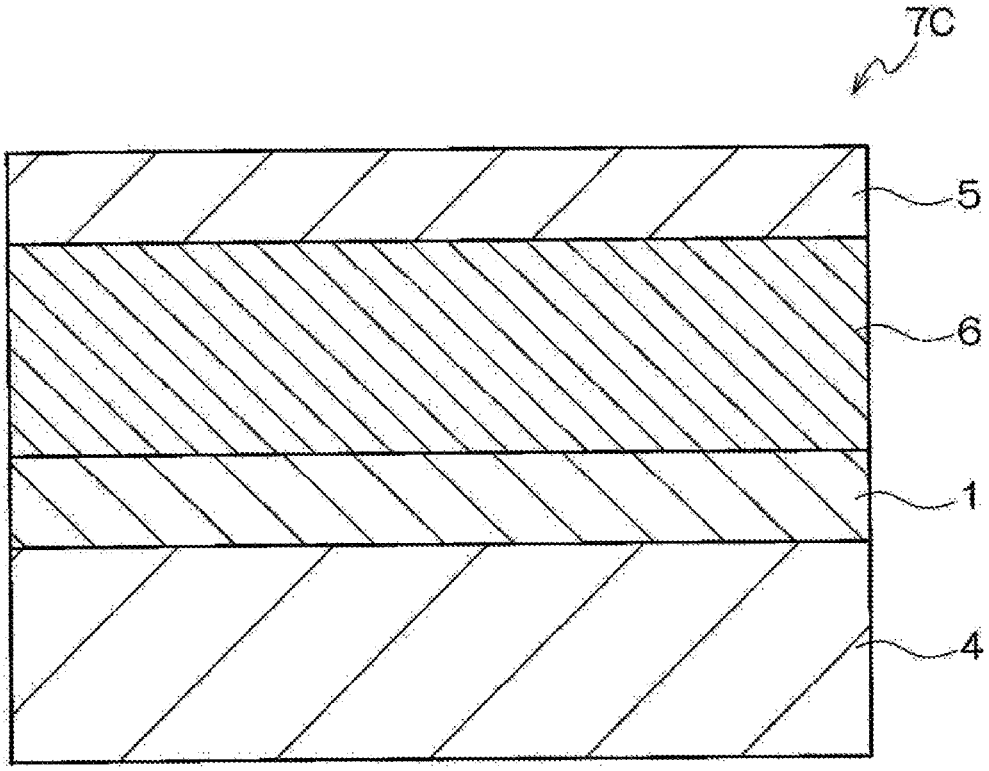
FIG. 3 is a schematic sectional view illustrating still another example of the layer configuration of the electrophotographic photoreceptor according to the exemplary embodiment.
Figure 4:
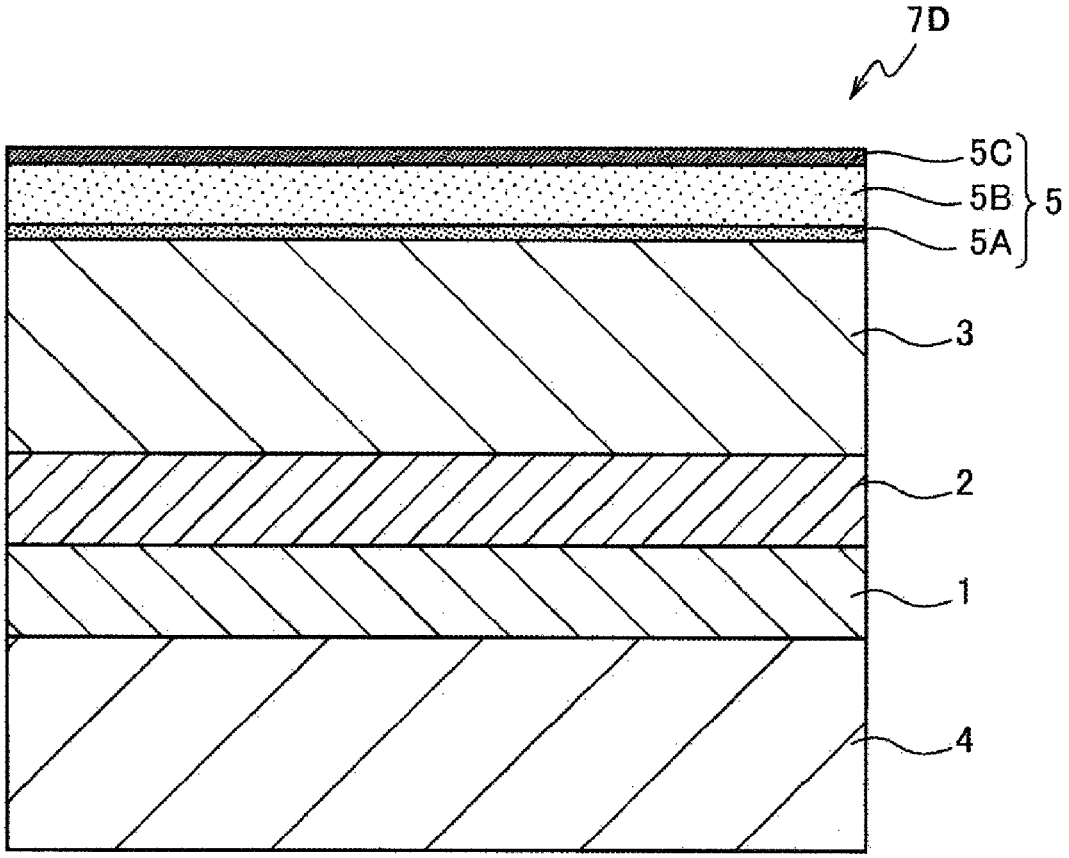
FIG. 4 is a schematic sectional view illustrating still another example of the layer configuration of the electrophotographic photoreceptor according to the exemplary embodiment.

FIG. 1 is a schematic sectional view illustrating an example of the electrophotographic photoreceptor according to this exemplary embodiment. FIGS. 2 to 4 are schematic sectional views illustrating other examples of the electrophotographic photoreceptor according to the exemplary embodiment.

An electrophotographic photoreceptor 7A illustrated in FIG. 1 is a so-called function separation type photoreceptor (or laminate type photoreceptor). The electrophotographic photoreceptor 7A has a structure in which an undercoat layer 1 is provided on an electroconductive substrate 4, and a charge generation layer 2, a charge transport layer 3, and an inorganic protective layer 5 are sequentially formed on the undercoat layer 1. In the electrophotographic photoreceptor 7A, the charge generation layer 2 and the charge transport layer 3 constitute the organic photosensitive layer.

The charge transport layer 3 contains a charge transporting material, a binder resin, and silica particles.

Similarly to the electrophotographic photoreceptor 7A illustrated in FIG. 1, an electrophotographic photoreceptor 7B illustrated in FIG. 2 is a function separation type photoreceptor in which a function is divided so as to be performed in the charge generation layer 2 and the charge transport layer 3 and the function of the charge transport layer 3 is separated. In an electrophotographic photoreceptor 7C illustrated in FIG. 3, a charge generation material and a charge transporting material are contained in the same layer (single-layer type organic photosensitive layer 6 (charge generation layer/charge transport layer)).

The electrophotographic photoreceptor 7B illustrated in FIG. 2 has a structure in which the undercoat layer 1 is provided on the electroconductive substrate 4, and the charge generation layer 2, a charge transport layer 3B, a charge transport layer 3A, and the inorganic protective layer 5 are sequentially formed on the undercoat layer 1. In the electrophotographic photoreceptor 7B, the charge transport layer 3A, the charge transport layer 3B, and the charge generation layer 2 constitute the organic photosensitive layer.

The charge transport layer 3A contains a charge transporting material, a binder resin, and silica particles. The charge transport layer 3B contains at least a charge transporting material. The charge transport layer 3B may contain or may not contain silica particles.

The electrophotographic photoreceptor 7C illustrated in FIG. 3 has a structure in which the undercoat layer 1 is provided on the electroconductive substrate 4, and the single-layer type organic photosensitive layer 6 and the inorganic protective layer 5 are sequentially formed on the undercoat layer 1.

The single-layer type organic photosensitive layer 6 contains a charge transporting material, a binder resin, and silica particles.

Similarly to the electrophotographic photoreceptor 7A illustrated in FIG. 1, an electrophotographic photoreceptor 7D illustrated in FIG. 4 has a structure in which the undercoat layer 1 is provided on the electroconductive substrate 4, and the charge generation layer 2, the charge transport layer 3, and the inorganic protective layer 5 are sequentially formed on the undercoat layer 1. In the electrophotographic photoreceptor 7D, the inorganic protective layer 5 is formed by three layers. A third layer (interfacial layer) 5A, a second layer (intermediate layer) 5B, and a first layer (outermost layer) 5C of the three layers are stacked on the charge transport layer 3 in this order from the organic photosensitive layer (charge transport layer 3).

The charge transport layer 3 contains a charge transporting material, a binder resin, and silica particles.

In the electrophotographic photoreceptors illustrated in FIGS. 1 to 4, the undercoat layer 1 may or may not be provided.

Components will be described below based on the electrophotographic photoreceptor 7A illustrated in FIG. 1 as a representative example. Descriptions with the omitted reference signs may be made.

Electroconductive Substrate

Examples of the electroconductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the electroconductive substrate include papers, resin films, and belts which are coated, deposited, or laminated with an electroconductive compound (such as a conductive polymer and indium oxide), a metal (such as aluminum, palladium, and gold), or alloys thereof. The term "conductive" means that the volume resistivity is smaller than $10^{13}$ Ωcm.

When the electrophotographic photoreceptor is used in a laser printer, the surface of the electroconductive substrate is preferably roughened so as to have a centerline average roughness (Ra) of 0.04 μm to 0.5 μm sequentially to prevent interference fringes which are formed when irradiated by laser light. Further, when an incoherent light is used as a light source, surface roughening for preventing interference fringes is not particularly necessary, but occurrence of defects due to the irregularities on the surface of the electroconductive substrate is prevented, which is thus suitable for achieving a longer service life.

As the method for surface roughening, wet honing in which an abrasive is suspended in water and sprayed onto the electroconductive substrate, centerless grinding in which the electroconductive substrate is pressed on a rotating whetstone and grinding is continuously performed, an anodic oxidation treatment, and the like are included.

Other examples of the method for surface roughening include a method for surface roughening by forming a layer of a resin in which conductive or semiconductive particles are dispersed on the surface of an electroconductive substrate so that the surface roughening is achieved by the particles dispersed in the layer, without roughing the surface of the electroconductive substrate.

In the surface roughening treatment by anodic oxidation, an oxide film is formed on the surface of an electroconductive substrate by anodic oxidation in which a metal (for example, aluminum) electroconductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be prevented.

The electroconductive substrate may be subjected to a treatment with an acidic aqueous solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binder resin.

Examples of the inorganic particles include inorganic particles having powder resistance (volume resistivity) of about $10^2$ Ωcm to $10^{11}$ Ωcm.

Among these substances, as the inorganic particles having the resistance values above, metal oxide particles such as tin oxide particles, titanium oxide particles, zinc oxide particles, and zirconium oxide particles are preferable, and zinc oxide particles are more preferable.

The specific surface area of the inorganic particles as measured by a BET method is, for example, preferably is equal to or greater than 10 $m^2/g$.

The volume average particle diameter of the inorganic particles is, for example, preferably from 50 nm to 2,000 nm (preferably from 60 nm to 1,000 nm).

The content of the inorganic particles is, for example, preferably from 10% by weight to 80% by weight, and more preferably from 40% by weight to 80% by weight, based on the binder resin.

The inorganic particles may be the ones which have been subjected to a surface treatment. The inorganic particles which have been subjected to different surface treatments or have different particle diameters may be used in combination of two or more types.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

A mixture of two or more types of the silane coupling agents may be used. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropyl methyl dimethoxy silane, N,N-bis(2-hydroxyethyl)-3-aminopropyl triethoxysilane, and 3-chloro-propyl trimethoxysilane. Examples of the silane coupling agent are not limited thereto.

The surface treatment method using a surface treatment agent may be any one of known methods, and may be either of a dry method and a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking property.

Examples of the electron acceptive compound include electron transporting materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, amino anthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The addition or spraying of the electron acceptive compound is preferably carried out at a temperature no higher than the boiling point of the solvent. After the addition or spraying of the electron acceptive compound, the inorganic particles may further be subjected to baking at a temperature of 100° C. or higher. The baking may be carried out at any temperature and timing without limitation, by which desired electrophotographic characteristics may be obtained.

The wet method is a method for attaching an electron acceptive compound to the surface of the inorganic particles, in which the inorganic particles are dispersed in a solvent by means of stirring, ultrasonic wave, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and timing without limitation, in which desired electrophotographic characteristics may be obtained. In the wet method, the moisture contained in the inorganic particles may be removed prior to adding the surface treatment agent, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound may be, for example, from 0.01% by weight to 20% by weight. The content thereof is preferably from 0.01% by weight to 10% by weight, based on the inorganic particles.

Examples of the binder resin used in the undercoat layer include known materials, such as well-known polymeric compounds such as acetal resins (for example, polyvinylbutyral and the like), polyvinyl alcohol resins, polyvinyl acetal resins, casein resins, polyamide resins, cellulose resins, gelatins, polyurethane resins, polyester resins, unsaturated polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binder resin used in the undercoat layer include charge transporting resins having charge transporting groups, and conductive resins (for example, polyaniline and the like).

Among these substances, as the binder resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins with curing agents are suitable.

In the case where these binder resins are used in combination of two or more types thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transporting pigments, zirconium chelate compounds, titanium chelate compounds, aluminum chelate compounds, titanium alkoxide compounds, organic titanium compounds, and silane coupling agents. A silane coupling agent, which is used for surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropyl methyl methoxy silane, N,N-bis(2-hydroxyethyl)-3-aminopropyl triethoxysilane, and 3-chloropropyl trimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used singly, or as a mixture or a polycondensate of two or more types thereof.

The Vickers hardness of the undercoat layer is preferably equal to or greater than 35.

The surface roughness of the undercoat layer (ten point height of irregularities) is adjusted in the range of 1/(4n) (n indicates a refractive index of an upper layer) of a wavelength λ to (½)λ. The wavelength λ represents a wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and cross-linked polymethyl methacrylate resin particles. In addition, the surface of the undercoat layer may be polished in order to adjust the surface roughness. Examples of the polishing method include buffing grinding, a sandblasting treatment, wet honing, and a grinding treatment.

The formation of the undercoat layer is not particularly limited, and well-known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming the coating liquid for forming the undercoat layer include alcohol solvents, aromatic hydrocarbon solvents, hydrocarbon halide solvents, ketone solvents, ketone alcohol solvents, ether solvents, and ester solvents.

Examples of these solvents include general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

As a method of coating the electroconductive substrate with the coating liquid for forming an undercoat layer, general methods such as a blade coating method, a wire bar coating method, a spraying method, a dipping coating method, a bead coating method, an air knife coating method, a curtain coating method, and the like are exemplified.

The film thickness of the undercoat layer is set to, for example, preferably be equal to or greater than 15 μm, and is set to be more preferably in a range of 20 μm to 50 μm.

Intermediate Layer

Although not shown in the drawings, an intermediate layer may be provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organic metal compound. Examples of the organic metal compound used in the intermediate layer include organic metal compounds containing a metal atom such as zirconium, titanium, aluminum, manganese, and silicon.

These compounds used in the intermediate layer may be used singly or as a mixture or a polycondensate of plural compounds.

Among these substances, layers containing organometallic compounds containing a zirconium atom or a silicon atom are preferable.

The formation of the intermediate layer is not particularly limited, and well-known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, general methods such as a dipping coating method, an extrusion coating method, a wire bar coating method, a spraying method, a blade coating method, a knife coating method, and a curtain coating method are used.

The film thickness of the intermediate layer is set to, for example, preferably from 0.1 μm to 3 μm. Further, the intermediate layer may be used as an undercoat layer.

Charge Generation Layer

The charge generation layer is, for example, a layer including a charge generation material and a binder resin. Further, the charge generation layer may be a layer in which a charge generation material is deposited. The layer in which the charge generation material is deposited is suitable for a case where a non-interfering light source such as a light emitting diode (LED) and an organic electro-luminescence (EL) image array.

Examples of the charge generation material include azo pigments such as bisazo and trisazo pigments; condensed aromatic pigments such as dibromoanthanthrone pigments; perylene pigments; pyrrolopyrrole pigments; phthalocyanine pigments; zinc oxides; and trigonal selenium.

Among these substances, in order to corresponding to laser exposure in the near-infrared region, it is preferable to use metal or nonmetal phthalocyanine pigments as the charge generation material, and specifically, hydroxygallium phthalocyanine; chlorogallium phthalocyanine; dichlorotin phthalocyanine; and titanyl phthalocyanine are more preferable.

In order to corresponding to laser exposure in the near-ultraviolet region, as the charge generation material, condensed aromatic pigments such as dibromoanthanthrone; thioindigo pigments; porphyrazine compounds; zinc oxides; trigonal selenium; and bisazo pigments are preferable.

In the case of using non-interfering light sources such as LED having a light emitting center wavelength at 450 nm to 780 nm and organic EL image arrays, the above charge generation materials may be used, but from the viewpoint of resolution, when a photosensitive layer is used as a thin film having a thickness of 20 μm or smaller, the field intensity in the photosensitive layer increases, and thus, a decrease in charging by charge injection from a substrate, or image defects such as so-called a black spots are easily formed. This becomes apparent when a charge generation material easily causing generation of dark currents as a p-type semiconductor such as trigonal selenium and phthalocyanine pigment.

On the contrary, in the case where n-type semiconductors such as condensed aromatic pigments, perylene pigments, azo pigments are used as a charge generation material, dark currents are not easily generated, and image defects called as a black spot may be prevented even when used as a thin film. Examples of the n-type charge generation material include the compounds (CG-1) to (CG-27) in paragraph Nos. [0288] to [0291] of JP-A-2012-155282, but are not limited thereto.

Determination of n-type ones may be conducted as follows: by employing a time-of-flight method commonly used, with the polarity of photocurrents, electrons that are easily flown out than holes as a carrier are determined as a n-type one.

The binder resin used in the charge generation layer may be selected from a wide range of insulating resins, and further, the binder resin may be selected from organic photoconductive polymers such as poly-N-vinyl carbazole, polyvinyl anthracene, polyvinyl pyrene, and polysilane.

Examples of the binder resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is equal to or greater than $10^{13}$ Ωcm.

These binder resins may be used singly or as a mixture of two or more types thereof.

Furthermore, the mixing ratio of the charge generation material and the binder resin is preferably in the range of 10:1 to 1:10 by weight ratio.

Well-known additives may be included in the charge generation layer.

The formation of the charge generation layer is not particularly limited, and well-known forming methods are used. However, the formation of the charge generation layer is carried out by, for example, forming a coating film of a coating liquid for forming a charge generation layer, the coating liquid obtained by adding the components above to a solvent, and drying the coating film, followed by heating, as desired. Further, the formation may also be carried out by deposition of a charge generation material. The formation of charge generation layer by deposition is particularly suitable for a case of using a condensed aromatic pigment or a perylene pigment as a charge generation material.

Examples of the solvent used for the preparation of the coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used singly or as a mixture two or more types thereof.

For a method for dispersing particles (for example, charge generation materials) in the coating liquid for forming a charge generation layer, for example, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion to collide against liquid or against walls under a high pressure, and a penetration system in which the particles are dispersed by causing the dispersion to penetrate through a fine flow path under a high pressure.

In addition, the average particle diameter of the charge generation materials in the coating liquid for forming a charge generation layer during the dispersion is effectively equal to or smaller than 0.5 μm, preferably equal to or smaller than 0.3 μm, and more preferably equal to or smaller than 0.15 μm.

As a method of coating the undercoat layer (or the intermediate layer) with the coating liquid for forming a charge generation layer, for example, general methods such as a blade coating method, a wire bar coating method, a spraying method, a dipping coating method, a bead coating method, an air knife coating method, a curtain coating method, and the like are exemplified.

The film thickness of the charge generation layer is set to a range of, for example, preferably from 0.1 μm to 5.0 μm, and more preferably from 0.2 μm to 2.0 μm.

Charge Transport Layer

Composition of Charge Transport Layer

The charge transport layer contains a charge transporting material, a binder resin, and silica particles.

Examples of the charge transporting material include electron transporting compounds, such as quinone compounds such as p-benzoquinone, chloranil, bromanil, and anthraquinone; tetracyanoquinodimethane compounds; fluorenone compounds such as 2,4,7-trinitro fluorenone; xanthone compounds; benzophenone compounds; cyanovinyl compounds; and ethylene compounds. Other examples of the charge transporting material include hole transport compounds such as triarylamine compounds, benzidine compounds, arylalkane compounds, aryl substituted ethylene compounds, stilbene compounds, anthracene compounds, and hydrazone compounds. These charge transporting materials may be used alone or in combination of two or more types thereof, but are not limited thereto.

As the charge transporting material, a triaryl amine derivative represented by the following formula (a-1) and a benzidine derivative represented by the following formula (a-2) are preferable from the viewpoint of charge mobility.

(a-1)

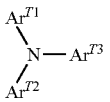

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$, and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent of each of the above groups include a halogen atom, an alkyl group having 1 to 5 carbon atoms, an alkoxy group having 1 to 5 carbon atoms. Other examples of the substituent with respect to each of the above groups include substituted amino groups substituted with an alkyl group having 1 to 3 carbon atoms.

(a-2)

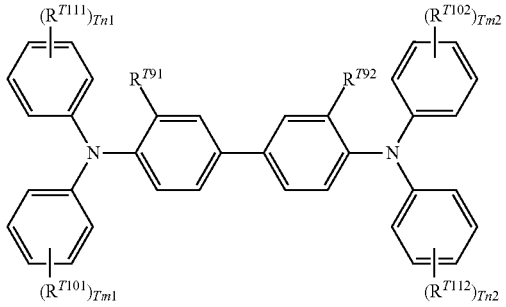

In the formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group; and Tm1, Tm2, Tn1 and Tn2 each independently represent an integer of 0 to 2.

Examples of the substituent with respect to each of the above groups include a halogen atom, an alkyl group having 1 to 5 carbon atoms, an alkoxy group having 1 to 5 carbon atoms. Other examples of the substituent with respect to each of the above groups include substituted amino groups substituted with an alkyl group having 1 to 3 carbon atoms.

Here, among the triarylamine derivatives represented by the formula (a-1) and the benzidine derivatives represented by the formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" are particularly preferable from the viewpoint of charge mobility.

As the polymeric charge transporting material, known materials having charge transporting properties such as poly-N-vinyl carbazole and polysilane are used. The polyester polymeric charge transporting are particularly preferable. In addition, the polymeric charge transporting material may be used solely or may be used in combination with a binder resin.

In this exemplary embodiment, the content of the silica particles may be equal to or more than 30% by weight with respect to the entirety of the charge transport layer, from a viewpoint of preventing the occurrence of cracks in the inorganic protective layer. From the similar viewpoint, the content of the silica particles may be equal to or more than 40% by weight, and is preferably equal to or more than 50% by weight. The upper limit value is not particularly limited. However, from a viewpoint of ensuring characteristics of the charge transport layer, the upper limit value may be equal to or smaller than 70% by weight. The upper limit value is preferably equal to or smaller than 65% by weight, and is more preferably equal to or smaller than 60% by weight.

Examples of the silica particles include dry silica particles and wet silica particles.

As the dry silica particle, combustion-method silica (fumed silica) and deflagration-method silica are exemplified. The combustion-method silica (fumed silica) is obtained by combusting a silane compound. The deflagration-method silica is obtained by explosively combusting metal silicon powder.

As the wet silica particles, wet silica particles obtained through a neutralization reaction of sodium silicate and mineral acid (sedimentation-method silica particles obtained through synthesis and aggregation under alkaline conditions, and gel-method silica particles obtained through synthesis and aggregation under acidic conditions), colloidal silica particles (silica-sol particles), and sol-gel silica particles are exemplified. The colloidal silica particles are obtained by causing silicic acid to become alkaline and performing polymerization. The sol-gel silica particles are obtained through hydrolysis of an organic silane compound (for example, alkoxysilane).

Among these types of particles, as the silica particles, the combustion-method silica particles which have a low void structure and in which the number of silanol groups on the surface is small are preferable from a viewpoint of occurrence of the residual potential, and prevention of occurrence of image defect (prevention of deterioration of thin line reproducibility) due to deterioration of other electrical characteristics.

A volume average particle diameter of the silica particles may be, for example, from 20 nm to 200 nm. The volume average particle diameter is preferably from 40 nm to 150 nm, more preferably from 50 nm to 120 nm, and further preferably from 50 nm to 110 nm.

If a combination of silica particles of which the volume average particle diameter is in the above range, and a binder resin of which the viscosity average molecular weight is less than 50,000 is used, the surface roughness of the charge transport layer is easily reduced more, and the occurrence of the image deletion is more easily prevented.

Silica particles are separated from the layer, and 100 primary particles among the separated particles are observed at magnification of 40,000 by a scanning electron microscope (SEM). The maximum length of each of the particles in a major axis and the minimum length thereof in a minor axis are measured through image analysis of the primary particles, and a sphere equivalent diameter is measured from an intermediate value between the maximum length and the minimum length. A 50% diameter (D50v) in cumulative frequency of the obtained sphere equivalent diameter is obtained, and the volume average particle diameter is measured by using the obtained 50% diameter as the volume average particle diameter of the silica particles.

The silica particle may have a surface subjected to the surface treatment by using a hydrophobizing agent. Thus, the number of silanol groups on the surface of the silica particle is reduced, and the occurrence of the residual potential is easily prevented.

As the hydrophobizing agent, a well-known silane compound such as chlorosilane, alkoxysilane, and silazane is exemplified.

Among these substances, a silane compound which has a trimethylsilyl group, a decylsilyl group, or a phenyl silyl group is preferable as the hydrophobizing agent from a viewpoint of easy prevention of the occurrence of the residual potential. That is, the trimethylsilyl group, the decylsilyl group, or the phenyl silyl group may be provided on the surface of the silica particle.

Examples of the silane compound having the trimethylsilyl group include trimethylchlorosilane, trimethylmethoxysilane, 1,1,1,3,3,3-hexamethyldisilazane, and the like.

Examples of the silane compound having the decylsilyl group include decyl trichlorosilane, decyl dimethylchlorosilane, decyl trimethoxysilane, and the like.

Examples of the silane compound having the phenyl group include triphenyl methoxy silane, triphenyl chlorosilane, and the like.

A condensation ratio of the silica particles which are treated with the hydrophobizing agent (ratio of Si—O—Si in a bond of $SiO_4$— in a silica particle: being also referred to as "a condensation ratio of the hydrophobizing agent" below) may be, for example, equal to or greater than 90% to the silanol groups on the surface of the silica particle, preferably equal to or greater than 91%, and more preferably equal to or greater than 95%.

If the condensation ratio of the hydrophobizing agent is in the above range, the number of silanol groups in the silica particle is reduced more, and the occurrence of the residual potential is easily prevented.

The condensation ratio of the hydrophobizing agent indicates a ratio of condensed silicon to all bondable sites of silicon at a condensation portion detected by a NMR. The condensation ratio of the hydrophobizing agent is measured as follows.

Firstly, the silica particles are separated from the layer. Si CP/MAS NMR analysis is performed on the separated silica particles by using AVANCEIII 400 (manufactured by Bruker Corporation). A peak area in accordance with the number of substitution of SiO is obtained. Values of 2-substituted ($Si(OH)_2(0\text{-}Si)_2$—), 3-substituted ($Si(OH)(0\text{-}Si)_3$—), and 4-substituted ($Si(0\text{-}Si)_4$—) are respectively set as Q2, Q3, and Q4, and the condensation ratio of the hydrophobizing agent is calculated by using an expression of $(Q2\times2+Q3\times3+Q4\times4)/4\times(Q2+Q3+Q4)$.

Volume resistivity of the silica particles may be, for example, equal to or greater than $10^{11}$ Ωcm, preferably equal to or greater than $10^{12}$ Ωcm, and more preferably equal to or greater than $10^{13}$ Ωcm.

If the volume resistivity of the silica particles is in the above range, deterioration of the electrical characteristics is prevented.

The volume resistivity of the silica particles is measured as follows. A measurement environment is set to be a temperature of 20° C. and humidity of 50% RH.

Firstly, the silica particles are separated from the layer. The separated silica particles to be measured are disposed on a surface of a circular jig having an electrode plate of 20 $cm^2$ provided thereon, so as to have a thickness of about 1 mm to 3 mm, and thereby forming a silica particle layer. A similar electrode plate of 20 $cm^2$ is placed on the formed silica particle layer, and thus the silica particle layer is interposed between the electrode plates. Since there is no void between silica particles, the thickness (cm) of the silica particle layer is measured after load of 4 kg is applied onto the electrode plate disposed on the silica particle layer. An electrometer and a high voltage power generating device are connected to both of the electrodes on and under the silica particle layer. A high voltage is applied to both of the electrodes such that an electric field has a predetermined value, and a current value (A) of a current flowing at this time is read, and thereby the volume resistivity (Ωcm) of the silica particles is calculated. A calculation formula of the volume resistivity (Ωcm) of the silica particles is as indicated by the following expression.

In the expression, ρ indicates the volume resistivity (Ωcm) of the silica particles. E indicates an application voltage (V). I indicates a current value (A) and $I_0$ indicates a current value (A) when the application voltage is 0 V. L indicates the thickness (cm) of the silica particle layer. In this evaluation, volume resistivity obtained when the application voltage is 1,000 V is used.

Expression: $\rho=E\times20/(I-I_0)/L$

Specific examples of the binder resin include polycarbonate resins (homopolymeric type resins of bisphenol A, bisphenol Z, bisphenol C, bisphenol TP, and the like, or copolymer resins type of the homopolymeric type resins), polyarylate resins, polyester resins, methacrylic resins, acrylic resins, polyvinyl chloride resins, polyvinylidene chloride resins, polystyrene resins, acrylonitrile-styrene copolymer, acrylonitrile-butadiene copolymer, polyvinyl acetate resins, styrene-butadiene copolymers, vinyl chloride-vinyl acetate copolymer, vinyl chloride-vinyl acetate-maleic anhydride copolymer, silicone resins, silicone-alkyd resins, phenol-formaldehyde resins, styrene-acrylic copolymer, atilen-alkyd resins, poly-N-polyvinyl carbazole resins, polyvinyl butyral resins, polyphenylene ether resin, and the like. The binder resin may be used singly or in combination of two or more types thereof.

The mixing ratio of the charge transporting material to the binder resin is preferably from 10:1 to 1:5 by weight ratio.

From a viewpoint of easily reducing the surface roughness of the charge transport layer more and more preventing the occurrence of the image deletion, polycarbonate resins (homopolymeric type resins of bisphenol A, bisphenol Z, bisphenol C, bisphenol TP, and the like, or copolymer resins type of the homopolymeric type resins) are preferable among the above-described binder resins. The polycarbonate resin may be used singly or may be used in combination of two or more types thereof. From a similar viewpoint, a homopolymeric type polycarbonate resin of bisphenol Z among the polycarbonate resins is more preferably contained.

Characteristics of Charge Transport Layer

Surface roughness Ra (arithmetic mean surface roughness Ra) of a surface of the charge transport layer, on which the inorganic protective layer is provided, may be, for example, equal to or smaller than 0.06 μm. For example, the surface roughness Ra is preferably equal to or smaller than 0.03 μm, and more preferably equal to or smaller than 0.02 μm.

If the surface roughness Ra is set to be in the above range, smoothness of the inorganic protective layer is improved, and cleaning properties are improved.

In order to set the surface roughness Ra to be in the above range, for example, a method of thickening the thickness of the layer is exemplified.

The surface roughness Ra is measured as follows.

Firstly, the inorganic protective layer is separated, and then, the layer to be measured is exposed. A portion of the exposed layer is cut out by a cutter, and thereby obtaining a measurement sample.

The measurement sample is measured by using a probe type surface roughness measurement device (SURFCOM 1400A: product manufactured by Tokyo Seimitsu Co., Ltd., and the like). Measurement conditions are based on JIS B0601-1994. As the measurement conditions, an evaluation length Ln is set to 4 mm, a reference length L is set to 0.8 mm, and a cutoff value is set to 0.8 mm.

Elastic modulus of the charge transport layer may be preferably, for example, equal to or greater than 5 GPa, more preferably equal to or greater than 6 GPa, and further preferably equal to or greater than 6.5 GPa.

If the elastic modulus of the charge transport layer is set to be in the above range, an occurrence of a recessed portion in the inorganic protective layer is easily prevented, and the occurrence of cracks in the inorganic protective layer is easily prevented.

In order to set the elastic modulus of the charge transport layer to be in the above range, for example, a method of adjusting the particle diameter and the content of the silica particles, and a method of adjusting the type and the content of the charge transporting material are exemplified.

The elastic modulus of the charge transport layer is measured as follows.

Firstly, the inorganic protective layer is separated, and then, the layer to be measured is exposed. A portion of the exposed layer is cut out by a cutter, and thereby obtaining a measurement sample.

A depth profile for the measurement sample is obtained by using NANO INDENTER SA2 (manufactured by MTS Systems Corporation) and by using a continuous stiffness method (CSM) (U.S. Pat. No. 4,848,141). The elastic modulus is measured by using an average value which is obtained from measurement values at an indentation depth from 30 nm to 100 nm.

The film thickness of the charge transport layer may be, for example, from 10 μm to 40 μm. The film thickness of the charge transport layer is preferably from 10 μm to 35 μm, and more preferably from 15 μm to 30 μm.

If the film thickness of the charge transport layer is set to be in the above range, the occurrence of the cracks and the residual potential of the inorganic protective layer is easily prevented.

Formation of Charge Transport Layer

The formation of the charge transport layer is not particularly limited, and well-known forming methods are used. However, the formation of the charge transport layer is carried out by, for example, forming a coating film of a coating liquid for forming a charge transport layer, the coating liquid obtained by adding the components above to a solvent, and drying the coating film, followed by heating, as desired.

As a method of coating the charge generation layer with a coating liquid for forming a charge transport layer, for example, general methods such as a dipping coating method, an extrusion coating method, a wire bar coating method, a spraying method, a blade coating method, a knife coating method, and a curtain coating method are used.

As a dispersion method used when particles (for example, silica particles or fluororesin particles) are dispersed in the coating liquid for forming a charge transport layer, for example, a media dispersing machine such as a ball mill, a vibrating ball mill, an attritor, a sand mill, and a horizontal sand mill, or a medialess dispersing machine such as an agitator, an ultrasonic dispersing machine, a roll mill, and a high-pressure homogenizer is used. Examples of the high-pressure homogenizer include a collision system, and a penetration system. In the collision system, the particles are dispersed by causing the dispersion to collide against liquid or against walls under a high pressure. In the penetration system, the particles are dispersed by causing the dispersion to penetrate through a fine flow path under a high pressure.

Inorganic Protective Layer

Composition of Inorganic Protective Layer

The inorganic protective layer in the electrophotographic photoreceptor according to this exemplary embodiment is configured by materials as follows.

That is, the inorganic protective layer contains a group 13 element, an oxygen atom, and a hydrogen atom. The sum of element constitution ratios of the group 13 element, the oxygen atom, and the hydrogen atom to all elements constituting the inorganic protective layer is equal to or more than 90 atomic %.

Particularly, in the electrophotographic photoreceptor according to the first exemplary embodiment, regarding the materials constituting the inorganic protective layer, an element composition ratio (oxygen atom/group 13 element) of the oxygen atom and the group 13 element is 1.0 or more and less than 1.5. The element composition ratio is preferably from 1.03 to 1.47, more preferably from 1.05 to 1.45, and further preferably from 1.10 to 1.40. If the element composition ratio (oxygen atom/group 13 element) of the materials constituting the inorganic protective layer is in the above range, the occurrence of the image deletion is prevented, and the occurrence of the image blur is prevented. From the similar viewpoint, it is preferable that the group 13 element is gallium.

In a case of an electrophotographic photoreceptor in which an inorganic protective layer which has a small element composition ratio (for example, 1.2 or smaller) is provided so as to come into contact with an organic photosensitive layer which does not contain silica particles, the small element composition ratio causes electrons to easily flow in the surface of the inorganic protective layer. Thus, the image deletion may occur. On the contrary, in the electrophotographic photoreceptor according to this exemplary embodiment, the organic photosensitive layer contains silica particles, and thus the volume resistivity of the organic photosensitive layer is increased. Accordingly, even when the element composition ratio is small, the occurrence of the image deletion is prevented.

If the element composition ratio becomes small, the elastic modulus of the inorganic protective layer tends to be decreased. Thus, in a case where the inorganic protective layer is provided so as to come into contact with an organic photosensitive layer which does not contain silica particles, the inorganic protective layer is formed so as to have an element composition ratio which is increased (for example, exceeds 1.2). On the contrary, since the organic photosensitive layer contains silica particles, and thus the elastic modulus of the organic photosensitive layer is increased, an inorganic protective layer having a small element composition ratio may be formed.

Here, if the element composition ratio (oxygen atom/group 13 element (particularly, gallium)) is in the above range, the volume resistivity easily satisfies a range which is $5.0\times10^{7}$ Ωcm or more and less than $1.0\times10^{12}$ Ωcm. In this point, in the electrophotographic photoreceptor according to the second exemplary embodiment, materials constituting the inorganic protective layer may be the same as the materials constituting the inorganic protective layer of the electrophotographic photoreceptor according to the first exemplary embodiment.

In a case where, for example, a group 15 element such as N, P, and As is mixed, the sum of element constitution ratios of the group 13 element (particularly, gallium), an oxygen atom, and a hydrogen atom to all elements constituting the inorganic protective layer is equal to or more than 90 atomic %, and thus an influence of combining the group 15 element with the group 13 element (particularly, gallium), and the like are prevented. In addition, an appropriate range of the composition ratio (oxygen atom/group 13 element (particularly, gallium)) of the oxygen atom and the group 13 element (particularly, gallium), which may improve hardness or electrical characteristics of the inorganic surface layer is easily obtained. From the above viewpoint, the sum of the element constitution ratios is preferably equal to or more than 95 atomic %, more preferably equal to or more than 96 atomic %, and further preferably equal to or more than 97 atomic %

In addition to the inorganic material, in order to control the electrical conduction type, the inorganic protective layer may contain one or more element selected from, for example, C, Si, Ge, and Sn in a case of a n-type conduction type, and the inorganic protective layer may contain one or more element selected from, for example, N, Be, Mg, Ca, and Sr in a case of a p-type conduction type.

Here, when the inorganic protective layer is formed to contain a gallium atom and an oxygen atom, and if necessary, a hydrogen atom, an appropriate element constitution ratio is as follows, from a point of view of being excellent in mechanical strength, light-transmissive properties, and flexibility, and being excellent in electrical conduction controllability.

For example, the element constitution ratio of gallium may be from 15% by atom to 50% by atom, preferably from 20% by atom to 40% by atom, and more preferably from 20% by atom to 30% by atom, for all components of the inorganic protective layer.

For example, the element constitution ratio of an oxygen atom may be from 30% by atom to 70% by atom, preferably from 40% by atom to 60% by atom, and more preferably from 45% by atom to 55% by atom, for all components of the inorganic protective layer.

For example, the element constitution ratio of a hydrogen atom may be from 10% by atom to 40% by atom, preferably from 15% by atom to 35% by atom, and more preferably from 20% by atom to 30% by atom, for all components of the inorganic protective layer.

Here, the element constitution ratio of each of the elements, the atomic ratio, and the like in the inorganic protective layer are obtained in a state of including distribution in the thickness direction, by using Rutherford backscattering spectrometry (referred to as "RBS" below).

In the RBS, 3SDH PELLETRON (manufactured by NEC Corporation) is used as an accelerator, RBS-400 (manufactured by CE&A Corporation) is uses as an end station, and 3S-R10 is used as a system. The HYPRA program of CE&A Corporation is used for analysis.

Regarding measurement conditions of the RBS, He++ ion beam energy is set to 2.275 eV, a detection angle is set to 160°, and a grazing angle for an incident beam is set to about 109°.

Specifically, RBS measurement is performed as follows.

First, a He++ ion beam is vertically incident to a sample. An angle of a detector to the ion beam is set to 160°. A signal of He which is backwardly scattered is measured. The composition ratio and the film thickness are determined based on the detected energy of He and the detected intensity. The spectrum thereof may be measured by using two detection angles, in order to improve accuracy for obtaining the composition ratio and the film thickness. Measurement is performed by using two detection angles which are different from each other in resolution of a depth direction and backward scattering mechanics, and results of the measurement are cross-checked. Thus, the accuracy is improved.

The number of He atoms which are backwardly scattered by target atoms is determined only by three factors. The three factors are 1) an atomic number of the target atom, 2) energy of the He atom before scattering, and 3) a scattering angle.

It is assumed that density is calculated based on the measured composition, and the thickness is calculated on this assumption. The margin of an error in density is within 20%.

The element constitution ratio of a hydrogen atom is obtained through hydrogen forward scattering (referred to as "HFS" below).

In HFS measurement, 3SDH PELLETRON (manufactured by NEC Corporation) is used as an accelerator, RBS-400 (manufactured by CE&A Corporation) is uses as an end station, and 3S-R10 is used as a system. The HYPRA program of CE&A Corporation is used for analysis. Measurement conditions of the HFS are as follows.

He++ ion beam energy: 2.275 eV

Detection angle: 30° of grazing angle to incident beam at 160°

In the HFS measurement, an angle of the detector to the He++ ion beam is set to 30°, and a sample is set to be inclined to a normal line by 75°. A signal of a hydrogen atom which is scattered on the front of the sample is picked under these settings. At this time, the detector may be covered with an aluminum foil, and He atoms which are scattered along with a hydrogen atom may be removed. Determination of the quantity is performed in such a manner that the hydrogen atom in a reference sample and a sample to be measured is counted, values obtained by the counting are standardized with stopping power, and then the standardized values are compared to each other. A sample obtained by injecting ions of H into Si, and muscovite are used as the reference sample.

It is known that muscovite has a hydrogen concentration of 6.5% by atom.

H adhering to the outermost surface is corrected by subtracting the quantity of H adhering to a clean Si surface, for example.

Characteristics of Inorganic Protective Layer

As described above, in the electrophotographic photoreceptor according to the second exemplary embodiment, the volume resistivity of the inorganic protective layer is $5.0\times10^{7}$ Ωcm or more and less than $1.0\times10^{12}$ Ωcm. From a viewpoint of easily preventing the occurrence of the image deletion more, and of easily preventing the occurrence of the image blur more, the volume resistivity of the inorganic protective layer is preferably from $8.0\times10^{7}$ Ωcm to $7.0\times10^{11}$ Ωcm, and more preferably from $1.0\times10^{8}$ Ωcm to $5.0\times10^{11}$ Ωcm, and further preferably from $5.0\times10^{8}$ Ωcm to $2.0\times10^{11}$ Ωcm.

It is preferable that the volume resistivity of the inorganic protective layer in the electrophotographic photoreceptor according to the first exemplary embodiment satisfies the range of the volume resistivity of the inorganic protective layer in the electrophotographic photoreceptor according to the second exemplary embodiment.

The volume resistivity is calculated and obtained from a resistance value, based on an area of an electrode and the thickness of a sample. The resistance value is measured under conditions of a frequency of 1 kHz and a voltage of 1 V by using LCR meter ZM2371 (manufactured by NF Corporation).

The measurement sample may be a sample obtained in such a manner that a film is formed on an aluminum substrate under the same conditions as conditions when an inorganic protective layer to be measured is formed, and a gold electrode is formed on the film-formed object by vacuum deposition. The measurement sample may be a sample obtained in such a manner that an inorganic protective layer is separated from the prepared electrophotographic photoreceptor and a portion of the separated inorganic protective layer is etched, and the etched portion is interposed between a pair of electrodes.

The inorganic protective layer is preferably a non-single crystal film such as a crystallite film, a polycrystalline film, and an amorphous film. Among these films, the amorphous film is particularly preferable in smoothness of a surface. The crystallite film is more preferably in a point of hardness.

A growth section of the inorganic protective layer may have a columnar structure. However, from a point of view of slipperiness, a structure having high flatness is preferable and the amorphous film is preferable.

Crystallinity and amorphous properties are distinguished based on whether or not a dot or a line is in a diffraction image obtained through measurement using reflection high-energy electron diffraction (RHEED).

The elastic modulus of the inorganic protective layer may be from 30 GPa to 80 GPa. The elastic modulus thereof is preferably from 40 GPa to 65 GPa.

If the elastic modulus is set to be in the above range, an occurrence of a recessed portion (dent scar), separation, or cracks of the inorganic protective layer is easily prevented.

A depth profile is obtained by the continuous stiffness method (CSM) (U.S. Pat. No. 4,848,141) and by using NANO INDENTER SA2 (manufactured by MTS Systems Corporation). An average value is obtained from measurement values at an indentation depth from 30 nm to 100 nm. The average value is used for the elastic modulus. Measurement conditions are as follows.

Measurement environment: 23° C., 55% RH

Use depressor: regular triangular pyramid depressor (Berkovic depressor), triangular pyramid depressor formed of diamond Test mode: CSM mode The measurement sample may be a sample obtained by forming a film on a base under the same conditions as conditions used when an inorganic protective layer to be measured is formed. The measurement sample may be a sample obtained in such a manner that an inorganic protective layer is separated from the prepared electrophotographic photoreceptor and a portion of the separated inorganic protective layer is etched.

The film thickness of the inorganic protective layer may be, for example, from 0.2 μm to 10.0 μm. The film thickness thereof is preferably from 0.4 μm to 5.0 μm.

If the film thickness is set to be in the above range, the occurrence of a recessed portion (dent scar), separation, or cracks of the inorganic protective layer is easily prevented.

Formation of Protective Layer

For example, a general vapor phase film deposition method is used for forming a protective layer. Examples of the general vapor phase film deposition method include a plasma chemical vapor deposition (CVD) method, an organic metal vapor phase growth method, a molecular beam epitaxy method, vapor deposition, sputtering, and the like.

Formation of an inorganic protective layer will be described below by using an example of a film forming apparatus with reference to the drawing, as a specific example. A method of forming an inorganic protective layer which contains a gallium atom, an oxygen atom, and a hydrogen atom will be described below. However, it is not limited thereto, and a well-known forming method may be applied in accordance with a composition of a desired inorganic protective layer.

Figure 5A:
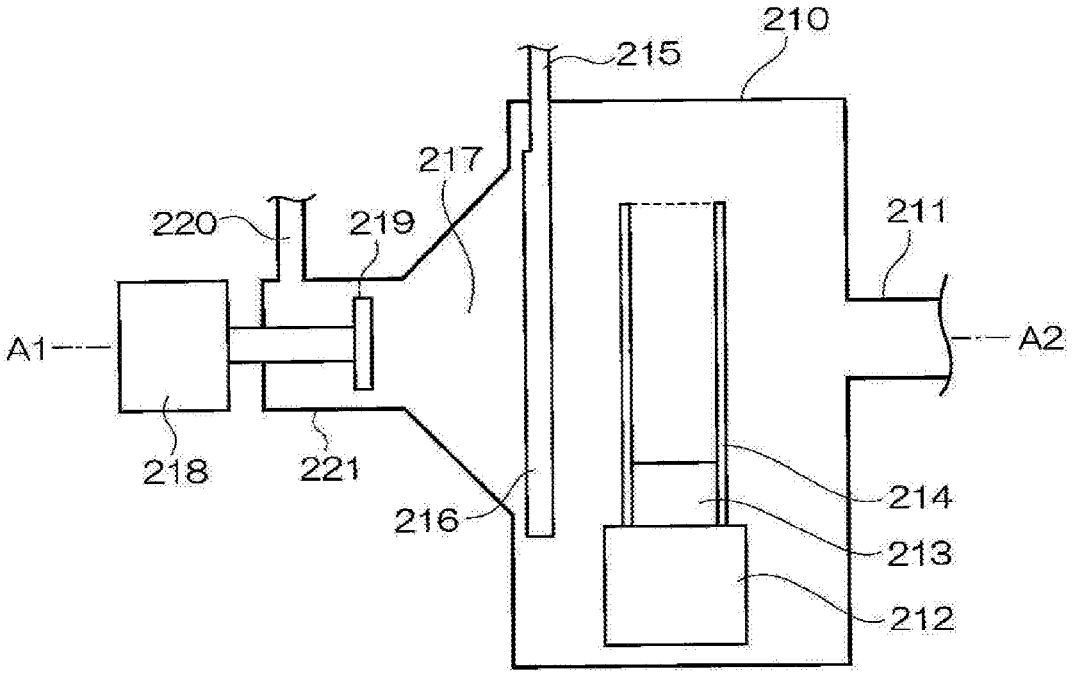
FIGS. 5A and 5B are schematic diagrams illustrating an example of a film forming apparatus used in forming an inorganic protective layer of the electrophotographic photoreceptor according to the exemplary embodiment.
Figure 5B:
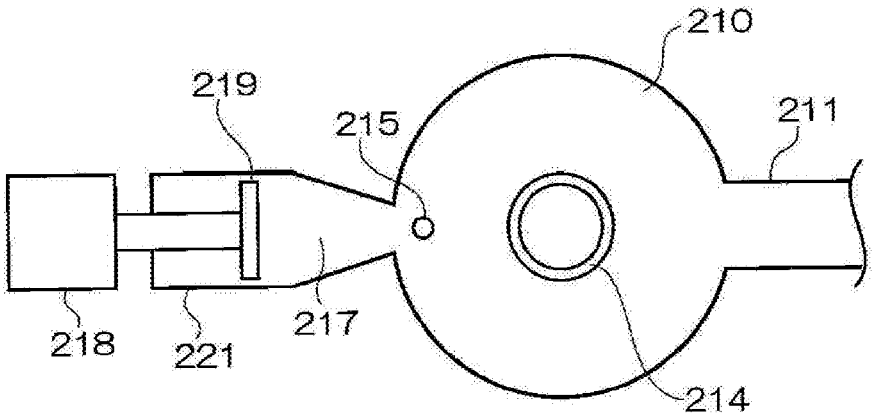

FIGS. 5A and 5B are schematic diagrams illustrating an example of the film forming apparatus used for forming the inorganic protective layer of the electrophotographic photoreceptor according to this exemplary embodiment. FIG. 5A illustrates a schematic cross-section when the film forming apparatus is viewed from a side. FIG. 5B illustrates a schematic cross-section obtained by taking the film forming apparatus illustrated in FIG. 5A along line A1-A2. In FIGS. 5A and 5B, the reference sign of 210 indicates a film formation chamber, and the reference sign of 211 indicates an exhaust port. The reference sign of 212 indicates a substrate rotating unit, and the reference sign of 213 indicates a substrate support member. The reference sign of 214 indicates a substrate, and the reference sign of 215 indicates a gas introduction tube. The reference sign of 216 indicates a shower nozzle which has an opening and ejects gas put from the gas introduction tube 215. The reference sign of 217 indicates a plasma diffusing portion, and the reference sign of 218 indicates a high-frequency power supply unit. The reference sign of 219 indicates an electrode plate, the reference sign of 220 indicates a gas introduction tube, and the reference sign of 221 indicates a high-frequency discharge tube portion.

In the film forming apparatus illustrated in FIGS. 5A and 5B, the exhaust port 211 is provided at one end of the film formation chamber 210. The exhaust port 211 is connected to a vacuum evacuation device (not illustrated). The high-frequency power supply unit 218, the electrode plate 219, and the high-frequency discharge tube portion 221 constitute a plasma generating apparatus. The plasma generating apparatus is provided on an opposite side of the film formation chamber 210 side, on which the exhaust port 211 is provided.

The plasma generating apparatus includes the high-frequency discharge tube portion 221, the electrode plate 219, and the high-frequency power supply unit 218. The electrode plate 219 is disposed in the high-frequency discharge tube portion 221 and a discharge surface of the electrode plate 219 is provided on the exhaust port 211 side. The high-frequency power supply unit 218 is disposed on the outside of the high-frequency discharge tube portion 221 and is connected to a surface on an opposite side of the discharge surface of the electrode plate 219. The gas introduction tube 220 is connected to the high-frequency discharge tube portion 221. The gas introduction tube 220 is used for supplying gas into the high-frequency discharge tube portion 221. Another end of the gas introduction tube 220 is connected to a first gas supply source (not illustrated).

Figure 6:
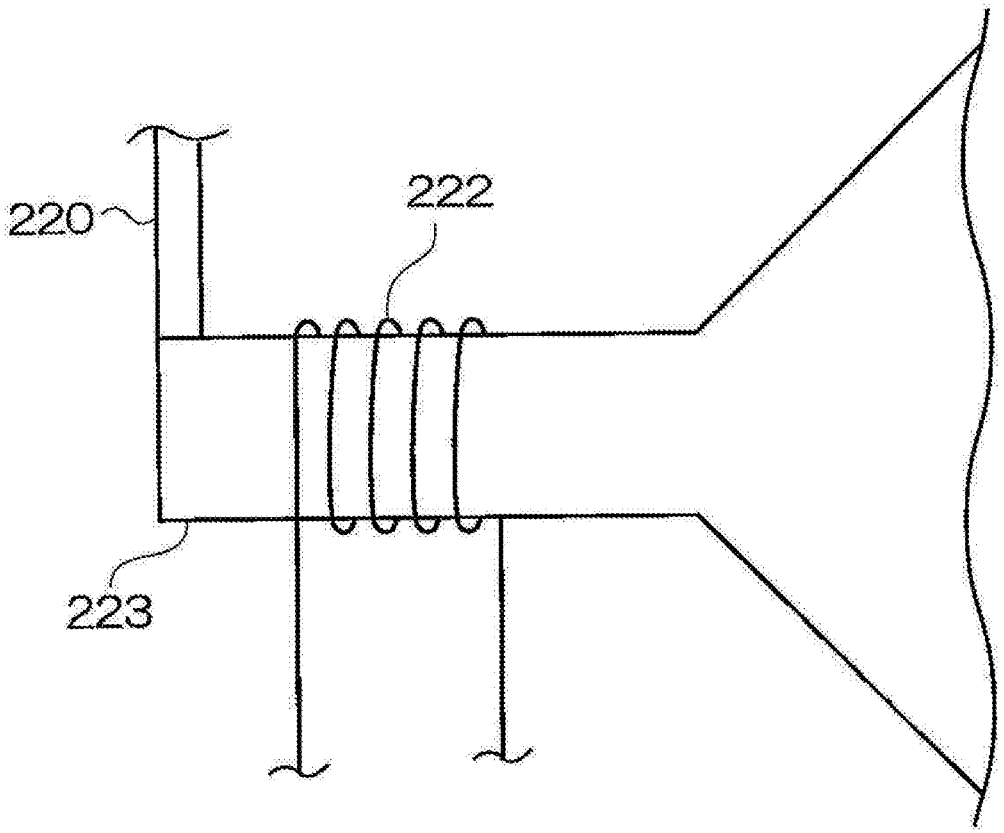
FIG. 6 is a schematic diagram illustrating an example of a plasma generating apparatus used in forming the inorganic protective layer of the electrophotographic photoreceptor in the exemplary embodiment.

Instead of the plasma generating apparatus provided in the film forming apparatus illustrated in FIGS. 5A and 5B, a plasma generating apparatus illustrated in FIG. 6 may be used. FIG. 6 is a schematic diagram illustrating another example of the plasma generating apparatus used in the film forming apparatus illustrated in FIGS. 5A and 5B. FIG. 6 is a side view of the plasma generating apparatus. In FIG. 6, the reference sign of 222 indicates a high-frequency coil and the reference sign of 223 indicates a silica tube. The reference sign of 220 indicates a gas introduction tube, similarly to the gas introduction tube illustrated in FIGS. 5A and 5B. This plasma generating apparatus includes the silica tube 223, and the high-frequency coil 222 provided along an outer circumferential surface of the silica tube 223. One end of the silica tube 223 is connected to the film formation chamber 210 (not illustrated in FIG. 6). The gas introduction tube 220 for putting gas into the silica tube 223 is connected to another end of the silica tube 223.

In FIGS. 5A and 5B, the shower nozzle 216 is extended along the discharge surface and has a bar shape. In FIG. 10, the shower nozzle 216 is connected to the discharge surface side of the electrode plate 219, one end of the shower nozzle 216 is connected to the gas introduction tube 215, and the gas introduction tube 215 is connected to a second gas supply source (not illustrated) provided on the outside of the film formation chamber 210.

The substrate rotating unit 212 is provided in the film formation chamber 210. The cylindrical substrate 214 is attached to the substrate rotating unit 212 through the substrate support member 213 such that the shower nozzle 216 faces the substrate 214 along a longitudinal direction of the shower nozzle 216 and an axial direction of the substrate 214. When a film is formed, the substrate rotating unit 212 is rotated and thus the substrate 214 is rotated in a circumferential direction. As the substrate 214, for example, a photoreceptor in which layers up to an organic photosensitive layer have been layered in advance, and the like is used.

The inorganic protective layer is formed, for example, as follows.

First, oxygen gas (or helium (He) diluted oxygen gas) and helium (He) gas, and if necessary, hydrogen ($H_2$) gas are put into the high-frequency discharge tube portion 221 from the gas introduction tube 220, and a radio wave of 13.56 MHz is supplied to the electrode plate 219 from the high-frequency power supply unit 218. At this time, the plasma diffusing portion 217 is formed so as to be widened from the discharge surface side of the electrode plate 219 to the exhaust port 211 side. Here, the gas put from the gas introduction tube 220 flows toward the exhaust port 211 side from the electrode plate 219 side through the film formation chamber 210. The electrode plate 219 may be obtained by surrounding the electrode with a ground shield.

The shower nozzle 216 is positioned on a downstream side of the electrode plate 219 which is an activation unit. Trimethyl gallium gas is put into the film formation chamber 210 through the gas introduction tube 215 and the shower nozzle 216. A non-single crystal film which contains a gallium atom and an oxygen atom is formed on the surface of the substrate 214.

As the substrate 214, for example, a substrate on which an organic photosensitive layer is formed is used.

Since an organic photoreceptor including an organic photosensitive layer is used, the temperature of the surface of the substrate 214 when the inorganic protective layer is formed is preferably equal to or lower than 150° C., more preferably equal to or lower than 100° C., and particularly preferably from 30° C. to 100° C.

Even when the temperature of the surface of the substrate 214 is equal to or lower than 150° C. at initial time when film formation is started, if the temperature becomes higher than 150° C. by an influence of plasma, the organic photosensitive layer may have damage due to heat. Thus, the surface temperature of the substrate 214 is preferably controlled considering this influence.

The temperature of the surface of the substrate 214 may be controlled by a heating unit, a cooling unit (not illustrated in the drawings), and the like. In addition, the temperature of the surface of the substrate 214 may be naturally increased during discharging. When the substrate 214 is heated, a heater may be installed on the outside or the inside of the substrate 214. When the substrate 214 is cooled, cooling gas or a cooling liquid may be circulated to the substrate 214.

When an increase of the temperature of the surface of the substrate 214 occurring by discharge is wanted to be avoided, it is effective that a gas flow having high energy which abuts on the surface of the substrate 214 be adjusted. In this case, conditions of a flow rate of the gas, a discharge output, pressure, and the like are adjusted so as to cause the temperature of the surface of the substrate 214 to be a required temperature.

Instead of the trimethyl gallium gas, an organometal compound containing aluminum, and hydride such as diborane may be used. In addition, combination of two or more types of these materials may be used.

For example, if trimethyl indium is put into the film formation chamber 210 through the gas introduction tube 215 and the shower nozzle 216, and thus a film containing a nitrogen atom and an indium atom is formed on the substrate 214, at initial time of formation of the inorganic protective layer, this film absorbs ultraviolet rays which are generated during continuous film formation and deteriorates the organic photosensitive layer. Thus, damage on the organic photosensitive layer occurring due to generation of the ultraviolet rays during film formation is prevented.

As a method of doping a dopant when a film is formed, $SiH_3$ and $SnH_4$ in a gas state are used as a n-type material. Biscyclopentadienyl magnesium, dimethyl calcium, dimethyl strontium, and the like in a gas state are used as a p-type material. In order to dope a dopant element into the surface layer, general methods such as a thermal diffusion method and an ion implantation method may be employed.

Specifically, for example, gas contains at least one or more type of dopant elements, and this gas is put into the film formation chamber 210 through the gas introduction tube 215 and the shower nozzle 216. Thus, an inorganic protective layer having a conductive type such as a n-type and a p-type is obtained.

In the film forming apparatus described by using FIGS. 5A to 6, plural activation devices may be provided and independently controlled and thus active nitrogen or active hydrogen which is generated by discharge energy may be independently controlled. Gas such as $NH_3$, containing nitrogen atoms and hydrogen atoms together may be used. In addition, $H_2$ may be added or conditions of isolatedly generating active hydrogen from an organometal compound may be used.

The film is formed in this manner, and thus carbon atoms, gallium atoms, nitrogen atoms, and hydrogen atoms which have been activated are present on the surface of the substrate 214, in a state of being controlled. Thus, there is an effect that hydrogen atoms of hydrocarbon such as methyl group or ethyl group, which constitutes the organometal compound are separated in a form of a hydrogen molecule by activated hydrogen atoms.

Thus, a hard film (inorganic protective layer) for forming a three-dimensional bond is formed.

A plasma generation unit of the film forming apparatus illustrated in FIGS. 5A to 6 uses a high-frequency oscillation device. However, it is not limited thereto. For example, a microwave oscillation device may be used or a device of an electrocyclotron resonance type or a helicon plasma type may be used. The high-frequency oscillation device may be an induction type or a capacity type.

Combination of two or more types of these devices may be used. In addition, two or more devices of the same type may be used. In order to prevent an increase of the surface temperature of the substrate 214 due to emission of plasma, the high-frequency oscillation device is preferable. However, a device of preventing emission of heat may be provided.

When two or more different types of plasma generating apparatuses (plasma generation units) are used, it is preferable that discharge is caused to occur simultaneously at the same pressure in the plasma generating apparatuses. A pressure difference between an area in which discharge is performed, and an area in which a film is formed (portion at which the substrate is installed) may be provided. These devices may be disposed in series with a gas flow which is formed from a portion at which gas is put, to a portion at which the gas is discharged, in the film forming apparatus. Either of the devices may be disposed so as to face a surface of the substrate, on which a film is formed.

For example, when two types of plasma generation units are installed so as to be in series with the gas flow, if the film forming apparatus illustrated in FIGS. 5A and 5B is used as an example, one of the two types of plasma generation units is used as a second plasma generating apparatus which uses the shower nozzle 216 as an electrode and causes discharge in the film formation chamber 210. In this case, for example, a high-frequency voltage is applied to the shower nozzle 216 through the gas introduction tube 215 and thus discharge is caused in the film formation chamber 210 by using the shower nozzle 216 as an electrode. In addition, instead of using the shower nozzle 216 as an electrode, a cylindrical electrode is provided between the substrate 214 and the electrode plate 219 in the film formation chamber 210 and discharge is caused in the film formation chamber 210 by using the cylindrical electrode.

When two different types of plasma generating apparatuses are used under the same pressure, for example, when a microwave oscillation device and a high-frequency oscillation device are used, an excitation type of excitation energy may be greatly changed. Thus, the above case is effective in control of film quality. The discharge may be performed at the vicinity (from 70,000 Pa to 110,000 Pa) of atmospheric pressure. When the discharge is performed at the vicinity of the atmospheric pressure, He is preferably used as carrier gas.

Regarding formation of the inorganic protective layer, for example, a substrate 214 on which an organic photosensitive layer has been formed is installed in the film formation chamber 210. A gas mixture having different compositions is put into the film formation chamber 210, and the inorganic protective layer is formed.

Regarding film formation conditions, for example, when discharge is performed by using a high-frequency discharging method, the frequency is preferably in a range of 10 kHz to 50 MHz, in order to form a film of good quality at a low temperature. An output for discharge depends on the size of the substrate 214, but is preferably in a range of 0.01 $W/cm^2$ to 0.2 $W/cm^2$ for the surface area of the substrate. The rotation speed of the substrate 214 is preferably in a range of 0.1 rpm to 500 rpm.

Hitherto, an example in which the organic photosensitive layer is a function separation type and the charge transport layer is a single-layer type is described as the electrophotographic photoreceptor. However, in a case of the electrophotographic photoreceptor illustrated in FIG. 2 (example in which the organic photosensitive layer is a function separation type and the charge transport layer is a multi-layer type), the charge transport layer 3A contacts with the inorganic protective layer 5 may have the same configuration as the charge transport layer 3 of the electrophotographic photoreceptor illustrated in FIG. 3. The charge transport layer 3B which does not contact with the inorganic protective layer 5 may have the same configuration as a well-known charge transport layer.

The film thickness of the charge transport layer 3A may be from 1 μm to 15 μm. The film thickness of the charge transport layer 3B may be from 15 μm to 29 μm.

In a case of the electrophotographic photoreceptor illustrated in FIG. 3 (an example in which the organic photosensitive layer is a single-layer type), the single-layer type organic photosensitive layer 6 (charge generation/charge transport layer) may have the same configuration as the photosensitive layer 3 except for including a charge generation material.

The content of the charge generation material in the single-layer type organic photosensitive layer 6 may be from 25% by weight to 50% by weight for the entirety of the single-layer type organic photosensitive layer.

The film thickness of the single-layer type organic photosensitive layer 6 may be set to be from 15 μm to 30 μm.

The inorganic protective layer may have distribution of the composition ratio in the thickness direction, in accordance with the purpose. The inorganic protective layer may have a multilayer configuration.

For example, in a case of the electrophotographic photoreceptor (example in which the inorganic protective layer is configured by the three layers of the third layer, the second layer, and the first layer) illustrated in FIG. 4, in each of the layers according to the first exemplary embodiment, the element composition ratio (oxygen atom/group 13 element (particularly gallium)) of the group 13 element (particularly, gallium) and the oxygen atom is 1.0 or more and less than 1.5. The element composition ratio is preferably from 1.03 to 1.47, more preferably from 1.05 to 1.45, and further preferably from 1.10 to 1.40.

Although not illustrated, similarly in a case where the inorganic protective layer is configured by two layers, the element composition ratio of the group 13 element (particularly, gallium) and the oxygen atom in each of the layers is in the above range.

As the second exemplary embodiment, the volume resistivity of each of the third layer, the second layer, and the first layer is $5.0\times10^{7}$ Ωcm or more and less than $1.0\times10^{12}$ Ωcm. In a point of easily preventing the occurrence of the image blur more and of easily preventing the occurrence of the image blur more, the volume resistivity thereof is preferably from $8.0\times10^{7}$ Ωcm to $7.0\times10^{11}$ Ωcm, more preferably from $1.0\times10^{8}$ Ωcm to $5.0\times10^{11}$ Ωcm, and further preferably from $5.0\times10^{8}$ Ωcm to $2.0\times10^{11}$ Ωcm.

Although not illustrated, similarly in a case where the inorganic protective layer is configured by two layers, the volume resistivity of each of the layers is in the above range.

Similarly to a case where the inorganic protective layer is a single layer, the film thickness of the inorganic protective layer may be, for example, from 0.2 μm to 10.0 μm (preferably 0.4 μm to 5.0 μm). The thickness of each of the layers may be in the following range, for example.

The film thickness of the third layer may be, for example, from 0.05 μm to 1.0 μm. The film thickness of the third layer is preferably more than 0.1 μm and 0.4 μm or smaller, and more preferably from 0.15 μm to 0.3 μm.

The film thickness of the second layer may be, for example, from 0.05 μm to 4.5 μm. The film thickness of the second layer is preferably from 0.1 μm to 4.0 μm.

The film thickness of the first layer may be, for example, from 0.05 μm to 2.0 μm. The film thickness of the first layer is preferably from 0.2 μm to 1.5 μm, and more preferably from 0.5 μm to 1.0 μm.

The element constitution ratio, an atomic number ratio, and the like of each element in each of the layers are obtained in a state of including distribution in the thickness direction, by using the known Rutherford backscattering spectrometry (referred to as "RBS" below).

Regarding formation of the inorganic protective layer, a gas mixture having different compositions is introduced in accordance with the desired element composition ratio or the desired volume resistivity, and thus the layers may be consecutively formed or may be independently formed. Regarding each of the layers, film formation conditions may be selected in accordance with the desired element composition ratio or the desired volume resistivity.

Image Forming Apparatus (and Process Cartridge)

An image forming apparatus/image forming method according to this exemplary embodiment will be described.

The image forming apparatus according to this exemplary embodiment includes an electrophotographic photoreceptor, a charging unit, an electrostatic latent image forming unit, a developing unit, and a transfer unit. The charging unit charges the surface of the electrophotographic photoreceptor. The electrostatic latent image forming unit forms an electrostatic latent image on the charged surface of the electrophotographic photoreceptor. The developing unit develops the electrostatic latent image formed on the surface of the electrophotographic photoreceptor by using a developer containing a toner, so as to form a toner image. The transfer unit transfers the formed toner image onto a surface of a recording medium. The electrophotographic photoreceptor according to this exemplary embodiment is applied as the electrophotographic photoreceptor. The number of rotations of the electrophotographic photoreceptor is equal to or more than 8.0 times per second.

An image forming method (image forming method according to this exemplary embodiment) is performed in the image forming apparatus according to this exemplary embodiment. The image forming method includes a charging process of charging the surface of the electrophotographic photoreceptor, an electrostatic latent image forming process of forming an electrostatic latent image on the charged surface of the electrophotographic photoreceptor, a developing process of developing the electrostatic latent image formed on the surface of the electrophotographic photoreceptor by using a developer containing a toner, so as to form a toner image, and a transfer process of transferring the formed toner image onto a surface of a recording medium. The number of rotations of the electrophotographic photoreceptor is equal to or more than 8.0 times per second.

As the image forming apparatus according to this exemplary embodiment, a well-known image forming apparatus is applied, and examples thereof include an apparatus including a fixing unit for fixing a toner image transferred onto a surface of a recording medium; a direct transfer type apparatus that directly transfers a toner image formed on a surface of an electrophotographic photoreceptor onto a recording medium; an intermediate transfer type apparatus that primarily transfers a toner image formed on a surface of an electrophotographic photoreceptor onto a surface of an intermediate transfer member, and then secondarily transfers the toner image which is primarily transferred onto the surface of the intermediate transfer member onto a surface of the recording medium; an apparatus including a cleaning unit that performs cleaning on a surface of an electrophotographic photoreceptor before charging after a toner image is transferred; an apparatus including an erasing unit that performs erasing by irradiating a surface of an electrophotographic photoreceptor with erasing light before charging after a toner image is transferred; and an apparatus including an electrophotographic photoreceptor heating member for increasing the temperature of the electrophotographic photoreceptor and reducing the relative temperature.

In the case of the intermediate transfer type device, for example, a configuration which has an intermediate transfer member, a primary transfer unit, and a secondary transfer unit is applied for the transfer unit. The intermediate transfer member has a surface to the surface of which the toner image is transferred. The primary transfer unit primarily transfers a toner image formed on the surface of the electrophotographic photoreceptor to the surface of the intermediate transfer member. The secondary transfer unit secondarily transfers the toner image transferred to the surface of the intermediate transfer member.

The image forming apparatus according to this exemplary embodiment may be any one of a dry developing type image forming apparatus, a wet developing type (developing type using a liquid developer) image forming apparatus.

In the image forming apparatus according to this exemplary embodiment, for example, a part including the electrophotographic photoreceptor may have a cartridge structure (process cartridge) which is detachable from the image forming apparatus. As the process cartridge, for example, a process cartridge including the electrophotographic photoreceptor according to this exemplary embodiment is applied. The process cartridge may include at least one selected from a group of, for example, the charging unit, the electrostatic latent image forming unit, the developing unit, and the transfer unit, in addition to the electrophotographic photoreceptor.

An example of the image forming apparatus according to this exemplary embodiment will be described below. However, the image forming apparatus is not limited to this example. Main components illustrated in the drawings will be described and descriptions of other components will be omitted.

Figure 7:
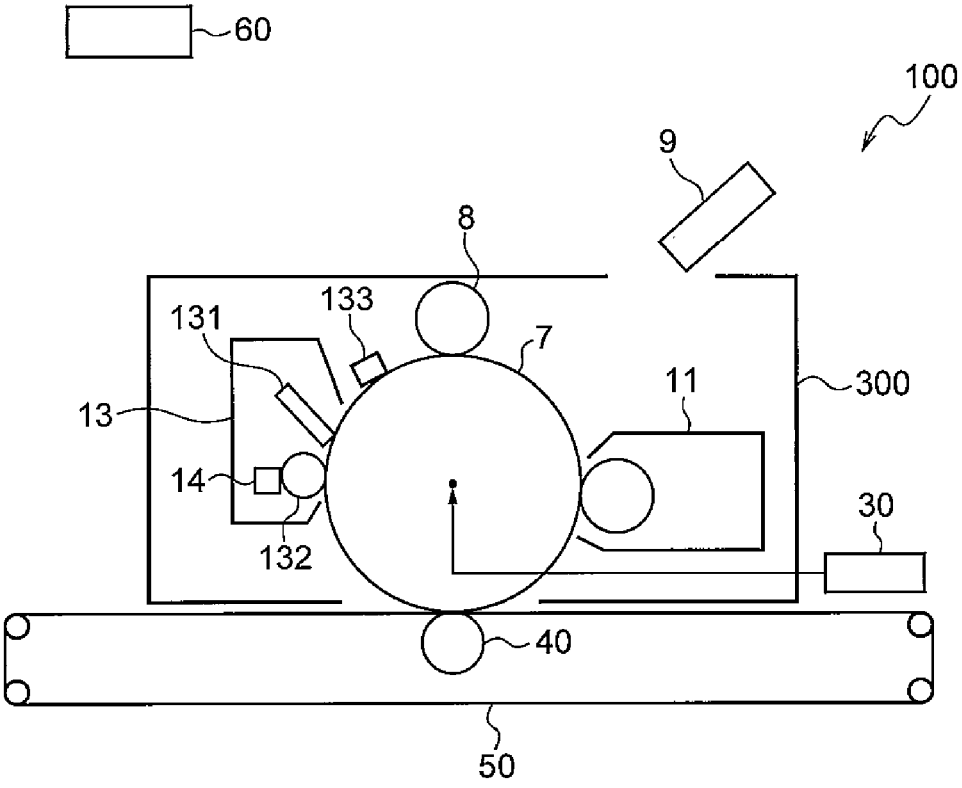
FIG. 7 is a schematic configuration diagram illustrating an example of an image forming apparatus according to the exemplary embodiment.

FIG. 7 is a schematic configuration diagram illustrating an example of the image forming apparatus according to this exemplary embodiment.

As illustrated in FIG. 7, the image forming apparatus 100 according to this exemplary embodiment includes a process cartridge 300 which includes an electrophotographic photoreceptor 7, an exposure device (example of the electrostatic latent image forming unit) 9, a transfer device (example of a primary transfer device) 40, and an intermediate transfer member 50. In the image forming apparatus 100, the exposure device 9 is disposed at a position at which the exposure device 9 may radiate light onto the electrophotographic photoreceptor 7 through an opening in the process cartridge 300. The transfer device 40 is disposed at a position opposite to the electrophotographic photoreceptor 7 with the intermediate transfer member 50 interposed between the transfer device 40 and the electrophotographic photoreceptor 7. The intermediate transfer member 50 is disposed so as to partially come into contact with the electrophotographic photoreceptor 7. Although not illustrated in FIG. 7, the apparatus also includes a secondary transfer device that transfers a toner image which has been transferred onto the intermediate transfer member 50 to a recording medium (for example, paper). The intermediate transfer member 50, the transfer device (primary transfer device) 40, and the secondary transfer device (not illustrated) correspond to an example of the transfer unit. In the image forming apparatus 100, the control device 60 (example of the control unit) is a device for controlling operations of each of the devices and each of the units which are in the image forming apparatus 100. The control device 60 is disposed so as to be connected to each of the devices and each of the units.

In the image forming apparatus 100 according to this exemplary embodiment, the number of rotations of the electrophotographic photoreceptor 7 is equal to or more than 8.0 times per second. An upper limit of the number of rotations of the electrophotographic photoreceptor 7 is not particularly limited. However, for example, the upper limit may be equal to or less than 17.7 times per second.

Specifically, the electrophotographic photoreceptor 7 is linked to a driving motor (example of a driving unit) 30 through a driving force transfer member (not illustrated) such as a gear. The driving motor 30 is electrically connected to a control device 60. The control device 60 controls operations of the devices and the members in the image forming apparatus 100. Driving of the driving motor 30 is controlled by the control device 60, and thus the electrophotographic photoreceptor 7 is driven with rotation at the number of rotations of being equal to or more than 8.0 times per second.

The process cartridge 300 in FIG. 7 supports, in a housing, the electrophotographic photoreceptor 7, a charging device (example of the charging unit) 8, a developing device (example of the developing unit) 11, and a cleaning device (example of a cleaning unit) 13 as one unit. The cleaning device 13 includes a cleaning blade (example of a cleaning member) 131. The cleaning blade 131 is disposed so as to contact with the surface of the electrophotographic photoreceptor 7. The cleaning member may be a conductive or insulating fibrous member, besides a form of the cleaning blade 131. The fibrous member may independently used solely or in combination with the cleaning blade 131.

FIG. 7 illustrates an example in which a (roll-shaped) fibrous member 132 for supplying a lubricant 14 onto the surface of the electrophotographic photoreceptor 7, and a (flat brush-shaped) fibrous member 133 for assisting cleaning are included, as the image forming apparatus. However, these components may be disposed as necessary.

Next, an image forming operation of the image forming apparatus 100 will be described.

The charging device 8 charges the surface of the electrophotographic photoreceptor 7 which rotates at the number of rotations which is equal to or more than 8.0 times per second. The exposure device 9 exposes the charged surface of the electrophotographic photoreceptor 7 based on image information. Thus, an electrostatic latent image is formed on the electrophotographic photoreceptor 7 in accordance with the image information. In the developing device 11, the electrostatic latent image formed on the surface of the electrophotographic photoreceptor 7 is developed by using a developer which contains a toner. Thus, a toner image is formed on the surface of the electrophotographic photoreceptor 7. The toner image formed on the surface of the electrophotographic photoreceptor 7 is transferred to the intermediate transfer member 50. The toner image which has been transferred to the intermediate transfer member 50 is transferred to a recording medium by a secondary transfer device (not illustrated). The toner image which has been transferred to the recording medium is fixed by a fixing device (not illustrated). The surface of the electrophotographic photoreceptor 7 after the toner image has been transferred is subjected to cleaning by the cleaning device 13.

The components of the image forming apparatus according to this exemplary embodiment will be described below.

Charging Device

As the charging device 8, for example, a contact type charger is used. The contact type charger uses a conductive or semiconductive charging roll, a charging brush, a charging film, a charging rubber blade, a charging tube, and the like. In addition, known chargers themselves such as a non-contact type roller charger, scorotron transfer charging device, and a corotron transfer charging device utilizing corona discharge are also used.

Exposure Device

Examples of the exposure device 9 includes an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in a range of the spectral sensitivity wavelengths of the electrophotographic photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which a developer is provided with or without contacting, may be used. Such a developing device 11 is not particularly limited as long as it has the above-described functions, and may be appropriately selected according to the intended use. Examples thereof include a known developing device in which the developer is applied to the electrophotographic photoreceptor 7 using a brush or a roller. Among these devices, the developing device using developing roller retaining developer on the surface thereof is preferable.

The developer used in the developing device 11 may be a single-component developer which contains only a toner, or may be a two-component developer which contains a toner and a carrier. The developer may be magnetic or may be non-magnetic. A well-known developer is applied as the developer.

Cleaning Device

As the cleaning device 13, a cleaning blade type device including the cleaning blade 131 is used.

In addition to the cleaning blade type, devices of a fur brush cleaning type and a developing and simultaneous cleaning type may be employed.

Transfer Device

Examples of the transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

Control Device

The control device 60 is configured as a computer which controls the entirety of the apparatus and performs various operations. Specifically, for example, the control device 60 includes a central processing unit (CPU), a read only memory (ROM) which stores various programs, a random access memory (RAM) which is used as a work area when the program is executed, a non-volatile memory in which various types of information are stored, and an input and output interface (I/O). The CPU, the ROM, the RAM, the non-volatile memory, and the I/O are connected to each other through a bus. Each of the units of the image forming apparatus 100, such as the electrophotographic photoreceptor (including the driving motor 30) 7, the charging device 8, the exposure device 9, the developing device 11, and the transfer device 40 is connected to the I/O.

For example, the CPU executes a program (for example, control program of an image forming sequence, a recovery sequence, or the like) stored in the ROM or the non-volatile memory so as to control an operation of each of the units of the image forming apparatus 100. The RAM is used as a work memory. For example, the program executed by the CPU, data required for processing of the CPU, or the like is stored in the ROM or the non-volatile memory. The control program or various types of data may be stored in other storage devices such as a storage unit, or may be obtained from the outside of the apparatus through a communication unit.

Various drives may be connected to the control device 60. As the various drives, a device of reading data from a portable computer-readable recording medium or a device of writing data in the recording medium are exemplified. Examples of the portable computer-readable recording medium include a flexible disk, a magneto-optic disc, a CD-ROM, a DVD-ROM, and a universal serial bus (USB) memory. In a case of including the various drives, the control program may be recorded in a portable recording medium, and a drive corresponding to the recording medium may read and execute the control program.

Figure 8:
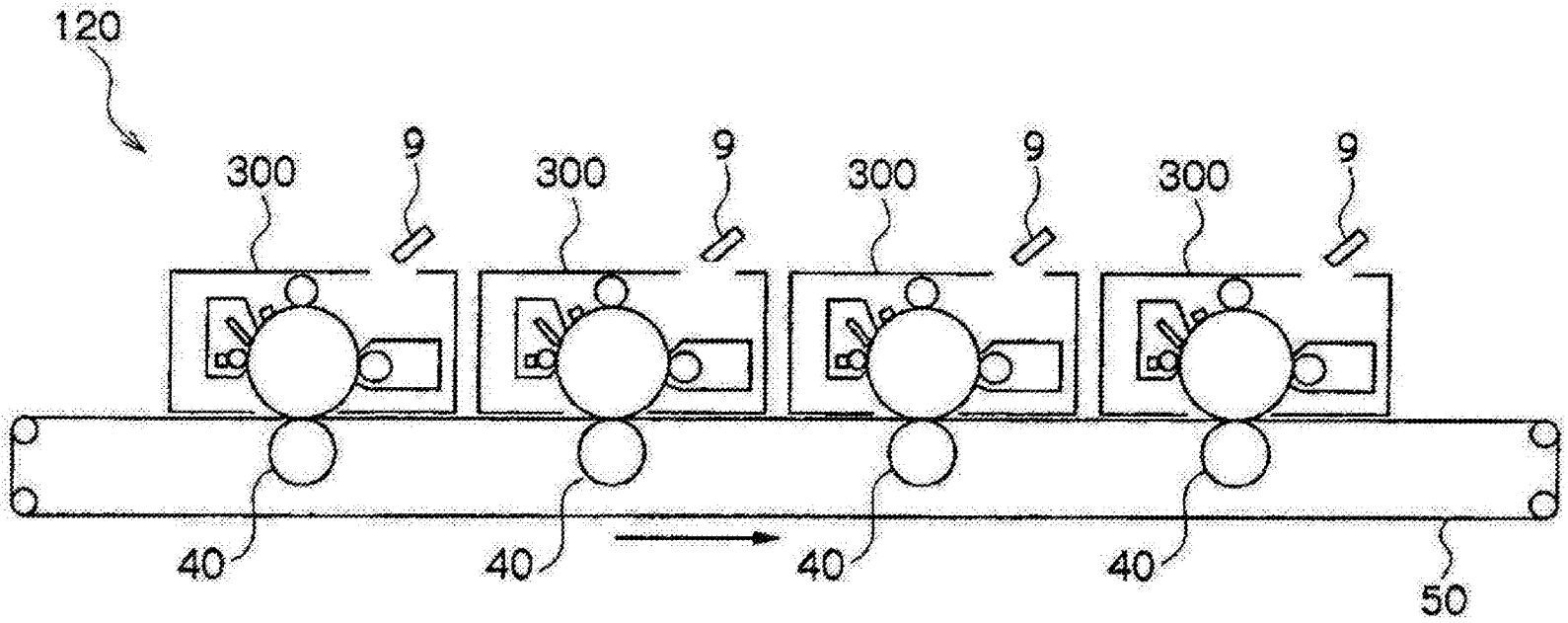
FIG. 8 is a schematic configuration diagram illustrating another example of the image forming apparatus according to the exemplary embodiment.

FIG. 8 is a schematic configuration diagram illustrating another example of the image forming apparatus according to this exemplary embodiment.

An image forming apparatus 120 illustrated in FIG. 8 is a tandem multicolor image forming apparatus in which four process cartridges 300 are installed. In the image forming apparatus 120, the four process cartridges 300 on the intermediate transfer member 50 are disposed in parallel, and each process cartridge 300 has a configuration in which one electrophotographic photoreceptor to which one color is assigned is used. The image forming apparatus 120 may have a similar configuration to the image forming apparatus 100, in addition to the tandem type.

The image forming apparatus 100 according to this exemplary embodiment is not limited to the above configuration. For example, the image forming apparatus 100 may include a first erasing device. The first erasing device is provided on a downstream side of the transfer device 40 in a rotation direction of the electrophotographic photoreceptor 7 and on an upstream side of the cleaning device 13 in the rotation direction of the electrophotographic photoreceptor, around the electrophotographic photoreceptor 7. The first erasing device sets the polarity of the remaining toner so as to easily remove the remaining toner by using a cleaning brush. In addition, the image forming apparatus 100 may include a second erasing device. The second erasing device is provided on a downstream side of the cleaning device 13 in the rotation direction of the electrophotographic photoreceptor and on an upstream side of the charging device 8 in the rotation direction of the electrophotographic photoreceptor. The second erasing device erases the surface of the electrophotographic photoreceptor 7.

The image forming apparatus 100 according to this exemplary embodiment is not limited to the above configurations and may employ a well-known configuration. For example, a direct transfer type apparatus that directly transfers a toner image formed on the surface of the electrophotographic photoreceptor 7 to a recording medium may be employed.

EXAMPLES

The exemplary embodiment of the invention will be specifically described below by using examples. However, the exemplary embodiment of the invention is not limited to the following examples. In the following examples, "a part" means a part by weight.

Preparation of Silica Particles

Silica Particles (1)

30 parts by weight of 1,1,1,3,3,3-hexamethyldisilazane (manufacturer: Tokyo Chemical Industry Co., Ltd.) are added as the hydrophobizing agent to 100 parts by weight of not-treated (hydrophilic) silica particles (product name: OX50 (manufacturer: Aerosil Corporation)), and a reaction is caused for 24 hours. Then, silica particles which are filtered and treated with the hydrophobizing agent are obtained. The obtained silica particles are used as silica particles (1). The condensation ratio of the silica particles (1) is 93%.

Example 1

Preparation of Undercoat Layer 100 parts by weight of zinc oxide (average particle diameter: 70 nm, product manufactured by Tayca Corporation, specific surface area value: 15 $m^2/g$) is mixed with 500 parts by weight of tetrahydrofuran with stirring. 1.3 parts by weight of the silane coupling agent (KBM503: product manufactured by Shin-Etsu Chemical Co., Ltd) are added and stirred for 2 hours. Then, tetrahydrofuran is subjected to distillation under reduced pressure and thus is distillated. Baking is performed at 120° C. for 3 hours, and thereby silane coupling agent surface-treatment zinc oxide particles are obtained.

110 parts by weight of the zinc oxide particles subjected to the surface treatment and 500 parts by weight of tetrahydrofuran are mixed and stirred. A liquid in which 0.6 parts by weight of alizarin is dissolved in 50 parts by weight of tetrahydrofuran is added and stirring is performed at 50° C. for 5 hours. Then, decompression filtration is performed and thus zinc oxide having alizarin applied thereto is separated. Decompression drying is performed at 60° C., and thereby alizarin-applied zinc oxide is obtained.

60 parts by weight of alizarin-applied zinc oxide, 13.5 parts by weight of the curing agent (blocked isocyanate, SUMIDUR 3175 product manufactured by Sumitomo Bayer urethane Corporation), and 15 parts by weight of a butyral resin (S-LEC BM-1, product manufactured by Sekisui Chemical Co., Ltd.) are dissolved in 85 parts by weight of methyl ethyl ketone, and thereby a solution is obtained. 38 parts by weight of the solution and 25 parts by weight of methyl ethyl ketone are mixed with each other, and a mixture obtained by mixing is dispersed in a sand mill by using glass beads of 1 mmφ, for 2 hours. Thus, a dispersion is obtained.

0.005 parts by weight of dioctyl tin dilaurate as a catalyst and 40 parts by weight of silicone resin particles (TOSPEARL 145, product manufactured by Momentive Performance Materials Inc.) are added to the obtained dispersion, and thereby the coating liquid for forming an undercoat layer is obtained. An aluminum substrate which is 60 mm in diameter, 357 mm in length, and 1 mm in thickness is coated with the coating liquid by using a dipping coating method. Drying and curing is performed at 170° C. for 40 minutes, and thereby an undercoat layer having a thickness of 19 μm is obtained.

Preparation of Charge Generation Layer 15 parts by weight of a hydroxy gallium phthalocyanine as the charge generation material, 10 parts by weight of a vinyl chloride-vinyl acetate copolymer (VMCH, product manufactured by NUC Corporation) as the binder resin, and 200 parts by weight of n-butyl acetate are mixed, and thereby a mixture is obtained. The mixture is dispersed in a sand mill by using glass beads having a diameter of 1 mmφ, for 4 hours. The hydroxy gallium phthalocyanine has diffraction peak at a position at which the Bragg angle) (2θ±0.2° in the X-ray diffraction spectrum using a Cukα characteristic X-ray is at least 7.3°, 16.0°, 24.9°, or 28.0°. 175 parts by weight of n-butyl acetate and 180 parts by weight of methyl ethyl ketone are added to the obtained dispersion and stirring is performed. Thus, a coating liquid for forming a charge generation layer is obtained. The undercoat layer is dip-coated with the coating liquid for forming a charge generation layer and is dried at the room temperature (25° C.), and thereby a charge generation layer having a film thickness of 0.2 μm is formed.

Preparation of Charge Transport Layer 250 parts by weight of tetrahydrofuran is put into 50 parts by weight of the silica particles (1). 25 parts by weight of 4-(2,2-diphenyl-ethyl)-4',4"-dimethyl-triphenylamine and 25 parts by weight of a bisphenol Z type polycarbonate resin (viscosity average molecular weight of 30,000) as the binder resin are added while maintaining a liquid temperature at 20° C. Mixing and stirring is performed for 12 hours, and thereby a coating liquid for forming a charge transport layer is obtained.

The charge generation layer is coated with the coating liquid for forming a charge transport layer, and the coating liquid is dried at 135° C. for 40 minutes, and thereby a charge transport layer having a film thickness of 30 μm is formed. Thus, an electrophotographic photoreceptor is obtained.

With the above processes, an organic photoreceptor (1) in which the undercoat layer, the charge generation layer, and the charge transport layer are layered on an aluminum substrate in this order is obtained.

Formation of Inorganic Protective Layer

Then, an inorganic protective layer formed of gallium oxide containing a hydrogen atom is formed on a surface of the organic photoreceptor (1). The inorganic protective layer is formed by using the film forming apparatus having a configuration illustrated in FIGS. 5A and 5B.

First, the organic photoreceptor (1) is placed on the substrate support member 213 in the film formation chamber 210 of the film forming apparatus. Vacuum evacuation of the film formation chamber 210 becomes performed through the exhaust port 211 until pressure becomes 0.1 Pa. This vacuum evacuation is performed within 5 minutes after substitution of a gas containing oxygen of high concentration is ended.

Then, He-diluted 40% oxygen gas (flow rate 1.6 sccm) and hydrogen gas (flow rate 50 sccm) are put into the high-frequency discharge tube portion 221 in which the electrode plate 219 having a diameter of 85 mm is provided, from the gas introduction tube 220. A radio wave of 13.56 MHz is set to have an output of 150 W, matching is performed by using a tuner, and the radio wave is applied to the electrode plate 219. Thus, discharge from the electrode plate 219 is performed by the high-frequency power supply unit 218 and a matching circuit (not illustrated in FIGS. 5A and 5B). At this time, a reflected wave has 0 W.

Then, trimethyl gallium gas (flow rate 1.9 sccm) is put into the plasma diffusing portion 217 in the film formation chamber 210, from the shower nozzle 216 through the gas introduction tube 215. At this time, reaction pressure in the film formation chamber 210, which is measured by a BARATRON vacuum gauge is 5.3 Pa.

In this state, a film is formed for 68 minutes while the organic photoreceptor (1) is rotated at a speed of 500 rpm, and thus an inorganic protective layer having a film thickness of 1.5 μm is formed on a surface of the charge transport layer of the organic photoreceptor (1).

With the above processes, an electrophotographic photoreceptor of Example 1, in which the undercoat layer, the charge generation layer, the charge transport layer, and the inorganic protective layer are sequentially formed on an electroconductive substrate, is obtained.

Examples 2 to 5, 8 to 9, and 11, and Comparative Examples 1 to 3

Similarly to Example 1, electrophotographic photoreceptors of Examples 2 to 5, Examples 8 and 9, and Example 11, and Comparative Examples 1 to 3 are obtained, except that the content of the silica particles, and the element composition ratio, volume resistivity, and the thickness (film thickness) of the inorganic protective layer are changed based on Table 1. The composition of the charge transport layer is adjusted so as to cause a value of % by weight of the silica particles to have a value in Table 1 by setting the entirety of the charge transport layer as 100.

Example 6

Regarding formation of the inorganic protective layer, similarly to Example 1, an electrophotographic photoreceptor of Example 6, in which the inorganic protective layer is formed by three layers, is obtained except for the following change.

Formation of Third Layer (Interfacial Layer)

Firstly, the organic photoreceptor (1) is placed on the substrate support member 213 in the film formation chamber 210 of the film forming apparatus. Vacuum evacuation of the film formation chamber 210 is performed through the exhaust port 211 until pressure becomes 0.1 Pa.

Then, a He-diluted 40% oxygen gas (3.5 sccm) and a $H_2$ gas (100 sccm) are put into the high-frequency discharge tube portion 221 in which the electrode plate 219 having a diameter of 85 mm is provided, from the gas introduction tube 220. A radio wave of 13.56 MHz is set to have an output of 200 W, matching is performed by using a tuner, and the radio wave is applied to the electrode plate 219. Thus, discharge from the electrode plate 219 is performed by the high-frequency power supply unit 218 and a matching circuit (not illustrated in FIGS. 5A and 5B). At this time, a reflected wave has 0 W.

Then, a trimethyl gallium gas (5 sccm) is put into the plasma diffusing portion 217 in the film formation chamber 210, from the shower nozzle 216 through the gas introduction tube 215. At this time, reaction pressure in the film formation chamber 210, which is measured by a BARATRON vacuum gauge is 10 Pa.

In this state, a film is formed for 15 minutes while the organic photoreceptor (1) is rotated at a speed of 100 rpm, and thus an interfacial layer having a film thickness of 0.2 μm is formed on a surface of the charge transport layer of the organic photoreceptor (1).

Formation of Second Layer (Intermediate Layer)

Then, high-frequency discharge is stopped, and a change to a He-diluted 40% oxygen gas (10 sccm) is performed. Then, the high-frequency discharge is started again.

In this state, a film is formed for 60 minutes while the organic photoreceptor (1) in which the interfacial layer has been formed is rotated at a speed of 100 rpm, and thus an intermediate layer having a film thickness of 0.8 μm is formed on the interfacial layer.

Formation of First Layer (Outermost Layer)

Then, high-frequency discharge is stopped, and a change to pressure (5 Pa) in the film formation chamber 210, a He-diluted 40% oxygen gas (2.2 sccm), a $H_2$ gas (300 sccm), and a trimethyl gallium gas (3.2 sccm) is performed. Then, the high-frequency discharge is started again.

In this state, a film is formed for 55 minutes while the organic photoreceptor (1) in which the interfacial layer and the intermediate layer have been sequentially formed is rotated at a speed of 100 rpm, and thus an outermost layer having a film thickness of 0.5 μm is formed on the intermediate layer.

Example 7

Regarding formation of the inorganic protective layer, similarly to Example 1, an electrophotographic photoreceptor of Example 7, in which the inorganic protective layer is formed by two layers, is obtained except for the following change.

Formation of Second Layer (Intermediate Layer)

Firstly, the organic photoreceptor (1) is placed on the substrate support member 213 in the film formation chamber 210 of the film forming apparatus. Vacuum evacuation of the film formation chamber 210 is performed through the exhaust port 211 until pressure becomes 0.1 Pa.

Then, a He-diluted 40% oxygen gas (3.5 sccm) and a $H_2$ gas (100 sccm) are put into the high-frequency discharge tube portion 221 in which the electrode plate 219 having a diameter of 85 mm is provided, from the gas introduction tube 220. A radio wave of 13.56 MHz is set to have an output of 200 W, matching is performed by using a tuner, and the radio wave is applied to the electrode plate 219. Thus, discharge from the electrode plate 219 is performed by the high-frequency power supply unit 218 and a matching circuit (not illustrated in FIGS. 5A and 5B). At this time, a reflected wave has 0 W.

Then, a trimethyl gallium gas (5 sccm) is put into the plasma diffusing portion 217 in the film formation chamber 210, from the shower nozzle 216 through the gas introduction tube 215. At this time, reaction pressure in the film formation chamber 210, which is measured by a BARATRON vacuum gauge, is 10 Pa.

In this state, a film is formed for 15 minutes while the organic photoreceptor (1) is rotated at a speed of 100 rpm, and thus an interfacial layer having a film thickness of 1.0 μm is formed on a surface of the charge transport layer of the organic photoreceptor (1).

Formation of First Layer (Outermost Layer)

Then, high-frequency discharge is stopped, and a change to pressure (5 Pa) in the film formation chamber 210, a He-diluted 40% oxygen gas (2.2 sccm), a $H_2$ gas (300 sccm), and a trimethyl gallium gas (3.2 sccm) is performed. Then, the high-frequency discharge is started again.

In this state, a film is formed for 55 minutes while the organic photoreceptor (1) in which the interfacial layer and the intermediate layer have been sequentially formed is rotated at a speed of 100 rpm, and thus an outermost layer having a film thickness of 0.5 μm is formed on the intermediate layer.

Example 10

Regarding formation of the inorganic protective layer, similarly to Example 1, an electrophotographic photoreceptor of Example 10, in which the inorganic protective layer is formed by a single layer, is obtained except for the following change.

250 parts by weight of tetrahydrofuran is put into 25 parts by weight of the silica particles (1). 25 parts by weight of 4-(2,2-diphenyl-ethyl)-4',4"-dimethyl-triphenylamine and 50 parts by weight of a bisphenol Z type polycarbonate resin (viscosity average molecular weight of 30,000) as the binder resin are added while maintaining a liquid temperature at 20° C. Mixing and stirring is performed for 12 hours, and thereby a coating liquid for forming a charge transport layer is obtained.

The charge generation layer is coated with the coating liquid for forming a charge transport layer, and the coating liquid is dried at 135° C. for 40 minutes, and thereby a charge transport layer having a film thickness of 30 μm is formed, and an electrophotographic photoreceptor is obtained.

Comparative Example 4

Similarly to Example 6, an electrophotographic photoreceptor of Comparative Example 4 is obtained, except that the element composition ratio and the volume resistivity of the inorganic protective layer are changed based on Table 1.

Reference Example 1

An electrophotographic photoreceptor of Reference Example 1 is prepared by operation procedures which are similar to those of the electrophotographic photoreceptor prepared in Comparative Example 4.

Evaluation

Regarding the electrophotographic photoreceptor obtained in Examples and Comparative Examples, evaluation of cracks, evaluation of image blur, and evaluation of image deletion in the following descriptions are performed. The electrophotographic photoreceptor obtained in each of the examples is attached to "DOCUCENTRE-VC7775" (number of rotations of a photoreceptor per second: 10.7 times) manufactured by Fuji Xerox Co., Ltd, and each of the evaluations in the following descriptions in each of Examples and Comparative Examples is performed.

The electrophotographic photoreceptor of Reference Example 1 is attached to "DOCUCENTRE-IV C5575" (number of rotations of a photoreceptor per second: 7.3 times) manufactured by Fuji Xerox Co., Ltd, and each of the evaluations in the following descriptions in Reference Example 1 is performed.

Evaluation of Cracks

A chart image having image density (area coverage) of 5% is continuously printed on 300,000 sheets of A4 paper under an environment of a temperature of 22° C. and 55% RH. Then, a range of 0.5 cm (circumferential direction)×3 cm (axial direction) of the center portion of the organic photoreceptor, and sites of 0.5 cm×3 cm at 6.5 cm from both ends of the organic photoreceptor toward the center are visually observed by using an optical microscope (product manufactured by Keyence Corporation: VK9500), and cracks per unit area (1 cm×1 cm) are calculated. The evaluation criteria are as follows.

Evaluation Criteria

A: the number of cracks is equal to or less than 5 pieces/$cm^2$ (level at which it is not regarded as an image defect)

B: the number of cracks is more than 5 pieces/$cm^2$ and 15 pieces/$cm^2$ or less (level at which it is not regarded as an image defect)

C: the number of cracks is more than 15 pieces/$cm^2$ and 100 pieces/$cm^2$ or less (level at which it is not regarded as an image defect, but developing to the image defect may occur if printing on 600,000 sheets or more)

D: the number of cracks is more than 100 pieces/$cm^2$ (level at which developing to the image defect may occur)

Evaluation of Image Blur

A chart image having image density (area coverage) of 5% is continuously printed on 300,000 sheets of A4 paper under an environment of a temperature of 22° C. and 55% RH. Then, a half-tone image having image density of 30% is printed on a sheet having an A3 size. Regarding the half-tone image, whether or not image blur occurs in an area corresponding to the area of the surface of the photoreceptor is observed at 27 magnifications by using VITINY (VT-101). Image evaluation is performed in accordance with the following criteria.

The measurement range is set to be a range of 3 cm (circumferential direction)×3 cm (axial direction) of the center portion of the image on the sheet, and sites of 3 cm×3 cm at 1.5 cm from both ends of the sheet image portion toward the center. The total value at the three locations is handled as the number of pieces of image blur.

Evaluation Criteria

A: the number of pieces of image blur or dot disturbance in an observation range is 0.

B: the number of pieces of image blur or dot disturbance in an observation range is from 1 to 3.

C: the number of pieces of image blur or dot disturbance in an observation range is from 4 to 10.

D: the number of pieces of image blur or dot disturbance in an observation range is equal to or more than 11.

Evaluation of Image Deletion

A chart image having image density (area coverage) of 5% is continuously printed on 5,000 sheets of A4 paper under an environment of a temperature of 22° C. and 55% RH. Then, the apparatus is has kept for 14 hours under the same environment. After 14 hours has elapsed, the entire half-tone image having image density of 40% is printed. After the apparatus has been kept, image deletion of the first sheet to the tenth sheet, and image deletion of the 50-th sheet are confirmed.

The evaluation criteria are as follows.

Evaluation Criteria

A: dot of the first image obtained after the apparatus has been kept is not disturbed.

B: dot of the first image obtained after the apparatus has been kept is disturbed. However, dot disturbance is recovered in the second sheet to the 10-th sheet. (level at which there is no problem as image quality since immediate recovery is performed)

C: dot is disturbed in 10 prints obtained after the apparatus has been kept. However, dot disturbance is recovered in sheets to the 50-th sheet.

D: dot disturbance occurs even 50 prints obtained after the apparatus has been kept. Dot is slightly disturbed in the 100-th sheet, or dot is slightly disturbed even when continuous printing has been performed on 5,000 sheets.

TABLE 1

| | | Inorganic protective layer | | | | | | Evaluation | | | |
|---|---|---|---|---|---|---|---|---|---|---|---|
| | Charge transport layer Silica particle (% by weight) | Number of layers | Composition ratio [oxygen]/[group 13] Third layer | Second layer | First layer | Volume resistivity (Ωcm) | Film thickness (μm) | Number of rotations of photoreceptor (times/second) | Cracks | Image blur | Image deletion |
| Example 1 | 50 | 1 | — | — | 1.25 | $6.60 \times 10^9$ | 1.5 | 10.3 | A | A | A |
| Example 2 | 50 | 1 | — | — | 1.42 | $1.10 \times 10^{11}$ | 1.0 | 10.3 | B | A | A |
| Example 3 | 50 | 1 | — | — | 1.13 | $9.80 \times 10^8$ | 2.0 | 10.3 | A | A | A |
| Example 4 | 50 | 1 | — | — | 1.45 | $6.30 \times 10^{11}$ | 1.0 | 10.3 | B | A | A |
| Example 5 | 50 | 1 | — | — | 1.02 | $1.00 \times 10^8$ | 1.5 | 10.3 | A | A | B |
| Example 6 | 50 | 3 | 1.25 | 1.35 | 1.20 | $6.50 \times 10^9$ | 1.5 | 10.3 | A | A | A |
| Example 7 | 50 | 2 | — | 1.25 | 1.15 | $2.90 \times 10^9$ | 1.5 | 10.3 | A | A | A |
| Example 8 | 50 | 1 | — | — | 1.15 | $1.50 \times 10^9$ | 1.0 | 10.3 | B | A | A |
| Example 9 | 50 | 1 | — | — | 1.05 | $4.00 \times 10^8$ | 1.0 | 10.3 | B | A | B |
| Example 10 | 25 | 1 | — | — | 1.15 | $2.90 \times 10^9$ | 1.5 | 10.3 | C | B | A |
| Example 11 | 50 | 1 | — | — | 1.0 | $6.10 \times 10^7$ | 1.0 | 10.3 | A | A | B |
| Comparative Example 1 | — | 1 | — | — | 1.25 | $6.60 \times 10^9$ | 1.0 | 10.3 | D | D | C |
| Comparative Example 2 | 50 | 1 | — | — | 0.95 | $2.00 \times 10^7$ | 1.0 | 10.3 | A | B | C |
| Comparative Example 3 | 50 | 1 | — | — | 1.50 | $7.80 \times 10^{13}$ | 1.0 | 10.3 | A | C | A |
| Comparative Example 4 | 50 | 3 | 1.30 | 1.50 | 1.20 | $5.50 \times 10^{12}$ | 1.5 | 10.3 | A | C | B |

TABLE 1-continued

| | Charge transport layer | Inorganic protective layer | | | | | | Evaluation | | | |
|---|---|---|---|---|---|---|---|---|---|---|---|
| | | Number | Composition ratio [oxygen]/[group 13] | | | Volume | Film | Number of rotations of | | | |
| | Silica particle (% by weight) | of layers | Third layer | Second layer | First layer | resistivity (Ωcm) | thickness (μm) | photoreceptor (times/second) | Cracks | Image blur | Image deletion |
| Reference Example 1 | 50 | 3 | 1.30 | 1.50 | 1.20 | $5.50 \times 10^{12}$ | 1.5 | 7.3 | A | A | A |

From the above result, it is recognized that evaluation results for the image deletion and the image blur in the Example are better than those in Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

an electroconductive substrate;

an undercoat layer on the electroconductive substrate;

an organic photosensitive layer on the undercoat layer, the organic photosensitive layer including:

a charge generation layer, and a charge transport layer provided on the charge generation layer and that contains a charge transporting material, a binder resin, and 30 wt % to 50 wt % of silica particles with respect to the charge transport layer; and an inorganic protective layer on the organic photosensitive layer and having a film thickness of from 1.0 μm to 2.0 μm, wherein:

the inorganic protective layer contains a gallium atom, an oxygen atom, and a hydrogen atom, a sum of element constitution ratios of the gallium atom, the oxygen atom, and the hydrogen atom to all elements constituting the inorganic protective layer is equal to or more than 90 atomic %, an element composition ratio (oxygen atom/gallium atom) of the oxygen atom and the gallium atom is 1.0 or more and 1.45 or less, and the inorganic protective layer has a volume resistivity of $6.1\times10^{7}$ Ωcm to $6.3\times10^{11}$ Ωcm.

2. A process cartridge that is detachable from an image forming apparatus, the process cartridge comprising:

the electrophotographic photoreceptor according to claim 1.

3. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor by using a developer that contains a toner to thereby form a toner image; and a transfer unit that transfers the toner image onto a surface of a recording medium, wherein the number of rotations of the electrophotographic photoreceptor is equal to or more than 8.0 per second.

* * * * *